US008365557B2

(12) United States Patent
Conti

(10) Patent No.: US 8,365,557 B2
(45) Date of Patent: Feb. 5, 2013

(54) DOUBLE-FEED KNITTING METHOD FOR A GARMENT SUCH AS TIGHTS OR THE LIKE, MACHINE TO IMPLEMENT SAID METHOD AND GARMENT PRODUCED THEREWITH

(75) Inventor: Paolo Conti, Firenze (IT)

(73) Assignee: Golden Lady Company S.p.A., Ancona (IT)

( * ) Notice: Subject to any disclaimer, the term of this patent is extended or adjusted under 35 U.S.C. 154(b) by 0 days.

(21) Appl. No.: 13/383,081

(22) PCT Filed: Dec. 11, 2009

(86) PCT No.: PCT/IT2009/000559

§ 371 (c)(1),
(2), (4) Date: Feb. 17, 2012

(87) PCT Pub. No.: WO2011/004407

PCT Pub. Date: Jan. 13, 2011

(65) Prior Publication Data

US 2012/0131721 A1 May 31, 2012

(30) Foreign Application Priority Data

Jul. 10, 2009 (IT) ..... FI2009A0156

(51) Int. Cl.
*D04B 9/10* (2006.01)

(52) U.S. Cl. ..... 66/14; 66/17; 66/177

(58) Field of Classification Search ..... 66/14, 18, 66/22, 19, 177, 144, 178 R
See application file for complete search history.

(56) References Cited

U.S. PATENT DOCUMENTS

| | | | | |
|---|---|---|---|---|
| 3,768,277 | A * | 10/1973 | Uhlir | 66/9 R |
| 3,815,385 | A * | 6/1974 | Gariboldi | 66/172 R |
| 3,975,924 | A | 8/1976 | Furia | |
| 4,011,738 | A | 3/1977 | Furia | |
| 5,718,128 | A * | 2/1998 | Lonati et al. | 66/14 |

FOREIGN PATENT DOCUMENTS

| | | |
|---|---|---|
| EP | 0 046 737 B1 | 8/1985 |
| EP | 0 387 210 A2 | 9/1990 |
| WO | 98/20192 A1 | 5/1998 |

* cited by examiner

*Primary Examiner* — Danny Worrell
(74) *Attorney, Agent, or Firm* — McGlew and Tuttle, P.C.

(57) ABSTRACT

The method comprises the phases of: knitting at least one part (5 A, 5B) of the body (1) with reciprocating motion of the two cylinders of a double-cylinder machine; —knitting the leg pieces (9 A, 9B) with a continuous rotational motion of the two cylinders (11, 13), a first leg piece being knitted by a first of said cylinders and a second leg piece being knitted by a second of said cylinders. It is provided for an arc of needles (C) to be maintained temporarily inactive on each of said two cylinders while knitting said at least one part (5 A, 5B) of the body (1) with reciprocating motion. Furthermore, it is provided that the temporarily inactive needles are set to work at the end of the knitting of said at least one part (5 A, 5B) of the body (1) with reciprocating motion, thus forming an interknitting line (CC) for joining the two leg pieces (9 A, 9B), then continuing the knitting with continuous rotary motion with all the needles (15) of both the cylinders (11, 13).

50 Claims, 14 Drawing Sheets

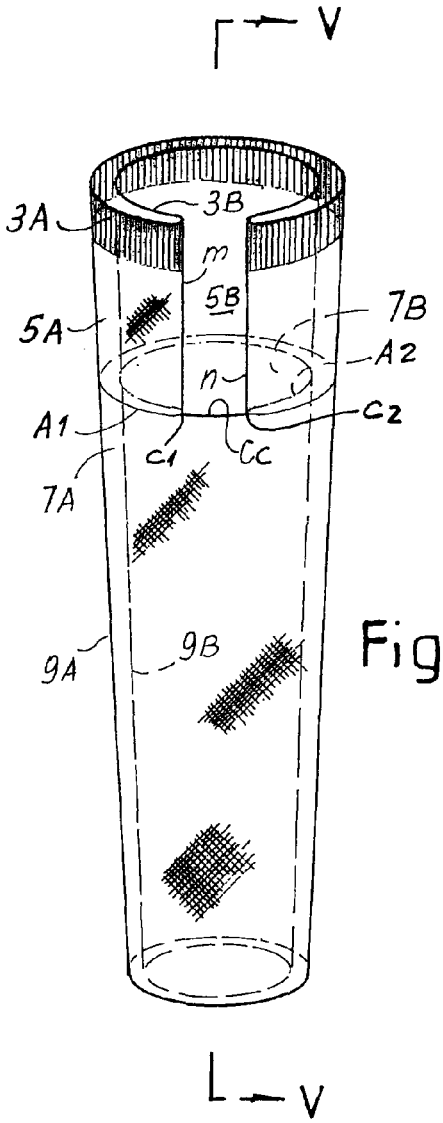
Fig. 4
Fig. 4A
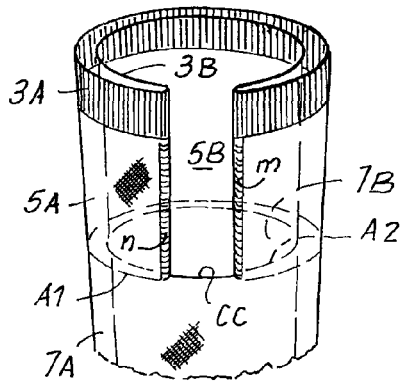
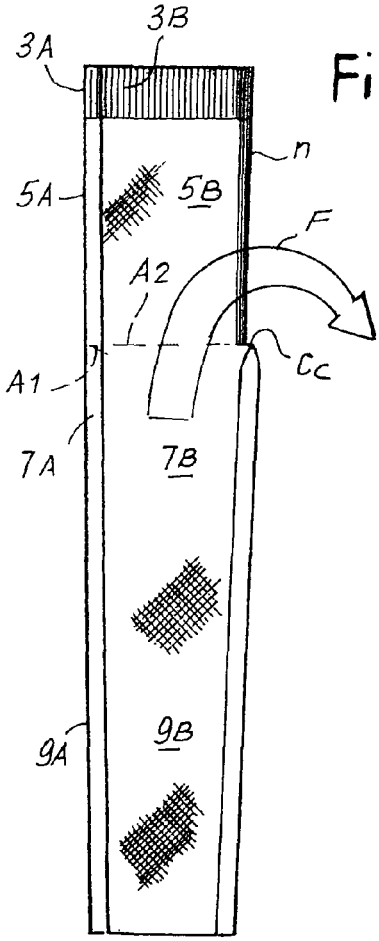
Fig. 5

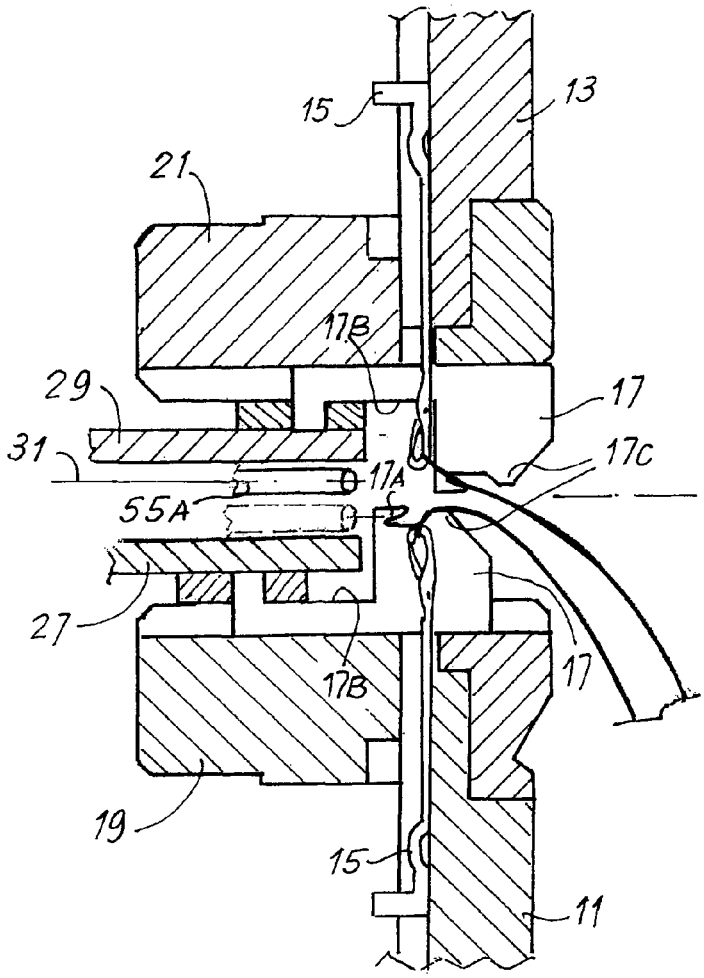
Fig.9
Fig.10
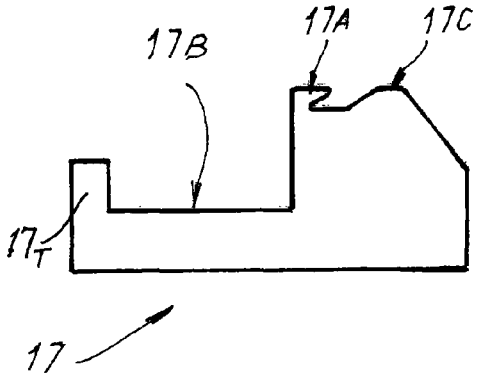

X
X
310
312
330
328
302
306
304
300
320
314
322
13
Y
318
216
328
332
334
214
11
Y
218
222
200
220
308
206
204
202
212
210
326
324

DOUBLE-FEED KNITTING METHOD FOR A GARMENT SUCH AS TIGHTS OR THE LIKE, MACHINE TO IMPLEMENT SAID METHOD AND GARMENT PRODUCED THEREWITH

TECHNICAL FIELD

The present invention relates to a garment, such as briefs, tights or the like, to a method and to a machine for knitting it.

STATE OF THE ART

Currently, the most widely used method for producing tights or the like is that of knitting two tubular knitted fabrics on a single-cylinder circular knitting machine, cutting them, in length direction, in the panty area and joining them by sewing together the respective cut edges. The tights produced in this way have a good fit, but the presence of seams is unsightly and uncomfortable, particularly in the inguinal area. To obtain a greater comfort, in some cases a fabric gusset is sewn in the inguinal area of the garment, thus however increasing the production cost of the pantyhose.

In order to overcome these drawbacks, various methods and corresponding knitting machines have been developed, as well as corresponding knitting machines for producing tights that have, when exit from the machine, an already wearable configuration, without the need for further seams in the panty area.

One of these methods is described, for instance, in the U.S. Pat. No. 4,011,738, granted on Mar. 15, 1977, and provides for knitting this kind of garment by means of a double-cylinder circular knitting machine. The machine produces a first tubular fabric, suitable to fit the pelvis by means of both the cylinders, which rotate with reciprocating motion and which work the same yarns, the needles of a cylinder working a first half of the tubular fabric when the cylinders rotate in one direction, and the needles of the other cylinder working the other half when the cylinders rotate in the opposite direction. Thereafter machine starts to rotate with continuous motion, contemporaneously producing with both the cylinders two other tubular fabrics, one for each cylinder, for the legs (hereinafter "leg pieces"), each of which is knitted as a continuation of a respective half of the first tubular fabric.

Even if, at first glance, the appearance of such a garment is completely acceptable thanks to the lack of seams in the panty, however it has some significant drawbacks that have prevented the industrial use of this knitting system. In particular, whilst working the panty with reciprocating motion, the two facing cylinders of the machine must be moved toward each other as much as possible, in order to minimize the interstitch connecting the two halves of the first tubular fabric. To allow the movement of the needles of a cylinder to pick-up the yarn and form stitch in one or more feeds without interfering with the corresponding needles of the other cylinder, only alternate needles are therefore used in both the cylinders, for example odd needles in the lower cylinder and even needles in the upper cylinder. As a result, the panty part is worked with half of the needles available in each cylinder, thus obtaining a more than halved stitch density relative to an equivalent garment sewn in a classic manner and knitted on a machine of equal fineness, and this significantly limits the fit and the covering power of the garment, especially in large sizes.

SUMMARY OF THE INVENTION

The object of the present invention is to provide a knit knitting method for a garment with a body and two leg pieces, such as for example a pair of briefs, pantyhose or the like, of the type described in the U.S. Pat. No. 4,011,738, but substantially improved, so as to overcome, partially or completely, at least one of the cited drawbacks.

This object is obtained with a knitting method for a knitted garment comprising a body and two leg pieces by means of a double-cylinder circular knitting machine, comprising the phases of:

- knitting at least one part of the body with reciprocating motion of the two cylinders;
- knitting the leg pieces with a continuous rotary motion of the two cylinders, a first leg piece being knitted by a first of said cylinders and a second leg piece being knitted by a second of said cylinders, wherein, whilst knitting the body with reciprocating motion of the two cylinders, all the needles of at least one arc of the upper cylinder and all the needles of a corresponding arc of needles of the lower cylinder are set to work, and at least two feeds and at least two yarns are used.

In this way, both the body and the leg pieces are produced with a similar density of stitches. The garment has a better fit. Furthermore, using at least two yarns and feeds for knitting also the body, it is possible to use in combination so-called "S" and "Z" yarns in combination. These yarns are obtained from covering a core made of an elastic yarn with a covering filament helically wound around the core. The yarns are called "S" or "Z" according to the direction of winding of the covering filament. As each yarn covered in this manner tends to curve in a direction according to the direction of winding of the covering filament, the use of two yarns of "S" and "Z" type allows to compensate the fact that the two yarns tend to curve in opposite manners, thus obtaining an article of better quality. This technique is known in the field of sock production, but it cannot be applied in the method described in the U.S. Pat. No. 4,011,738. Alternatively, parallel yarns can be used, in a number equal to or greater than two, therefore also in odd number, for example three, with three feeds.

It is possible to start knitting from the toe, or distal end, of the two leg pieces, working with continuous motion with the two cylinders to knit simultaneously the two leg pieces, and subsequently knitting the body with reciprocating motion. However, knitting of the body is preferably carried out firstly, starting from the waist thereof, followed by simultaneous knitting with continuous motion of the two leg pieces, ending with the toe thereof. Specific reference will be made hereunder to this second method of embodiment, but it must be understood that at least some of the advantageous characteristics and embodiments described with reference to this second method can be obtained also in the first method.

According to some embodiments of the method according to the present invention, a first tubular fabric, the upper part of the body, is substantially knitted by means of both the cylinders with a reciprocating motion, using a first arc of adjacent needles lower than 360°, i.e. lower than the overall number of needles of the cylinder. Thereafter, when said first tubular fabric has been knitted, the cylinders knit with continuous motion the lower part of the body and the two fabrics forming the leg pieces of the tights using all their needles. At the beginning of this second phase, needles of the two cylinders, that have not knitted during the previous phase, pick-up a same yarn to form at least one common initial partial course of stitches for connecting the two tubular fabrics of the leg pieces, this partial course of stitches defining, in the finished garment, a lower segment of the crotch line of the garment. Preferably, the partial course is formed with two yarns. The yarn(s) forming the partial courses define an interknitting, whose length is proportional to the number of needles that remained inactive during the reciprocating motion-knitting phase. These are the same yarns, with which the first part of the body of the tights has been formed during the knitting phase with reciprocating motion.

In this way, the pantyhose according to the present invention substantially has fit comfort and resistance substantially better than the comfort and resistance which can be obtained with the method described in the U.S. Pat. No. 4,011,738.

In a preferred embodiment of the present invention, the method is implemented by means of a double-cylinder machine, wherein the needles of each cylinder are offset by half a pitch relative to the needles of the other cylinder. In some preferred embodiments of the present inventions the sinkers have a doffing or recess to allow the corresponding needle of the other cylinder to form stitch. The so designed machine allows the two cylinders to be brought very near one to the other, thus obtaining a high-quality knitted article.

In this way, for processing the first tubular fabric with reciprocating motion all the needles of both the cylinders can be used, comprised in said first arc of adjacent needles. For instance, for knitting the panty each cylinder can use a 270° arc of needles, thus obtaining a stitch density highly similar to that of a pantyhose sewn in a classic manner, knitted on a machine of equal fineness whilst, as described above, the leg pieces of the pantyhose are connected to each other according to a joining line extending for a 90° arc of needles along the crotch. The pantyhose according to this embodiment of the present invention is therefore more comfortable to wear than the known tights.

In preferred embodiments of the present invention a method is provided for knitting a knitted garment comprising a body and two leg pieces by means of a double-cylinder circular knitting machine, comprising the steps of:

knitting at least one part of the body with reciprocating motion of the two cylinders;

knitting the leg pieces with a continuous rotary motion of the two cylinders, a first leg piece being knitted by a first of said cylinders and a second leg piece being knitted by a second of said cylinders.

It is furthermore provided for an arc of needles to be maintained temporarily inactive on each of said two cylinders during knitting of said at least one part of the body with reciprocating motion; and it is provided for said temporarily inactive needles to be set to work at the end of the knitting of said at least one part of the body with reciprocating motion, thus forming an interknitting line for joining the two leg pieces, then continuing knitting with continuous rotary motion with all the needles of both the cylinders.

In some embodiments of the method according t the present invention it is provided for said garment to be formed by joining three tubular fabrics. In this case preferably a first tubular fabric is obtained by means of both the cylinders of the machine, which rotate with reciprocating motion and work yarns fed by at least one yarn guide of at least one feed, the needles of a cylinder working when this cylinder rotates in one direction and the needles of the other cylinder working when this rotates in the opposite direction. Furthermore, the other two tubular fabrics are obtained by simultaneously and separately knitting a first of said other two fabrics by means of the first cylinder and a second of said other two fabrics by means of the second cylinder, by rotating the first and the second cylinder with a continuous motion and feeding the first and the second cylinder with respective yarns from respective yarn guides of at least one feed for each cylinder. In this embodiment of the invention, preferably to work the first fabric, each cylinder uses a first arc of adjacent needles having a number of needles lower than the overall number of needles of the cylinder, preferably maintaining for each cylinder a respective arc of needles inactive, and each of the two tubular fabrics are knitted by means of all the needles of the respective cylinder.

At the arc of needles remained inactive during the phase of knitting of said first part of the body, interknitting is formed with at least one partial course of common stitches along a crotch line of the garment, said at least one partial course being knitted by means of the needles of the arcs of needles of both the cylinders that remained inactive. The partial course of stitches is preferably formed with two yarns that in the previous phase have knitted with reciprocating motion the upper part of the body.

According to another aspect, the present invention relates to a double-cylinder circular knitting machine for producing a garment such as briefs, tights or the like, characterized by being programmed so as to carry out a knitting method as defined above. The double-cylinder circular machines are known per se to those skilled in the art, and do not require particular explanations herein. In general, they comprise a lower cylinder and an upper cylinder, coaxial to each other and arranged with opposite needles, i.e. the needles of the lower cylinder with the hooks facing upwards and the needles of the upper cylinder with the hooks facing downwards.

According to some embodiments of the present invention, the two cylinders are angularly offset relative to each other, in such a manner that each cylinder presents its own needles aligned with the sinkers of the other cylinder, so that the needles of a cylinder do not interfere with the needles of the other cylinder while working the garment, and both the cylinders can be used in their effective fineness for knitting all the parts of the garment.

According to a further aspect, the present invention also relates to a garment such as tights, briefs or the like, formed by joining tubular fabrics, wherein said tubular fabrics are joined together in a seam-freely manner according to respective courses of stitches, the garment being obtained by the above defined method.

According to an embodiment, the present invention provides for a knitted garment comprising a body and two leg pieces, joined along a crotch area, wherein said body and said leg pieces are formed by a continuous knitted seamless fabric, where in the crotch area a joining line is provided for joining the two leg pieces, formed by at least a partial interknitting course, common for the two leg pieces. The joining line is preferably formed by an interknitting of at least two courses.

According to some embodiments, the present invention provides a garment such as a pantyhose, briefs or the like, formed by joining tubular fabrics defining a body and two leg pieces, wherein both the body and the leg pieces are formed each by at least two yarns and with a similar stitch density for the leg pieces and the body. In some embodiments of the present invention the body comprises at least one portion, formed by a number of columns of stitches greater than the number of columns of stitches forming a single leg piece. In some embodiments of the present invention the number of columns of stitches of said part of the body is equal to the sum of the number of columns of stitches of the two leg pieces. In other preferred embodiments of the present invention, the number of columns of stitches of said part of the body is comprises between 1.4 and 2 times the number of columns of stitches forming a single leg piece. Preferably the number of columns of stitches of said part of the body is comprises between 1.5 and 1.9 times the number of columns of stitches forming a single leg piece.

In some embodiments of the present invention the body comprises at least one upper part, formed by two portions joined along two interstitch lines generated by the reversal of the reciprocating motion of the needle cylinders and consequent passage of the yarns from one to the other of the two circular needle beds of the double-cylinder machine on which the article is knitted. The two interstitch lines develop respectively on a front portion and on a back portion of the garment.

In some embodiments of the present invention the body comprises a lower part constituting the prosecution of the upper part of the body and developing until it forms the crotch area and the leg pieces of the garment. The interstitch lines extend in the upper part of the body and the front interstich line is joined to the back interstich line by means of the joining interknitting between the two leg pieces, which extends along the lower part of the body. In practice, the two interstich lines and the interknitting line of the crotch develop according to a curve extending from the front central area of the edge until the back central area of the edge of the garment, passing in the inguinal area, i.e. between the two leg pieces.

Practically, the body is advantageously formed by two columns of stitches extending from an waist of the body until the leg pieces, and, in the lower part, by further columns of stitches extending from said interknitting to said leg pieces.

In some embodiments of the present invention, whilst knitting with reciprocating motion the upper part of the body and the interknitting line of the crotch, the two cylinders, each together with the respective needles actuating cams, are moved axially, by means of a specific device, each towards the other as much as possible. In this way the length of the interstitch is reduced where the yarn passes from the needles of one cylinder to the needles of the other cylinder during the knitting phase with reciprocating motion of the body, so as to make almost invisible the joining lines that join a part of the body, knitted with reciprocating motion on a cylinder, with the corresponding part, knitted on the other cylinder.

In this case, in order to pick up the yarn and to form stitch, during the reciprocating motion the needles of each cylinder penetrate partially inserting between the needles of the opposite cylinder. In this situation, between the so interposed needles a minimum peripheral clearance remains tangentially to the cylinders. For instance, this clearance, for a machine of a 4-inch diameter with four hundred needles for cylinder, is in the order of 0.05 mm, and it is therefore clearly apparent that a high accuracy is needed for the motion transmission between the two cylinders to avoid that the needles of one cylinder come into contact with the needles of the other cylinder, and this accuracy can be obtained only by means of rectified and, as the case may be, doubled gears for taking up any construction clearance, and this entails a significant increase in the costs relative to a traditional machine.

To avoid this drawback, according to some embodiments of the present invention an angular connection device is provided between the cylinders, which is used only when the cylinders are adjacent to each other knitting with reciprocating motion. This device can comprise an axial pin fixed inside a cylinder at the point in which the reversal of the reciprocating motion occurs, with the passage of the yarn from one to the other of the two cylinders during the phase of knitting with reciprocating motion the body. The spin projects axially towards the other cylinder that carries a corresponding seat for said pin. The pin and the seat are so arranged that, with the needles moving reciprocally axially towards each other in the work arrangement to form the parts of the body with reciprocating motion, the pin is inserted in the seat, bringing the cylinders mutually in a specific angular position even if clearances of transmission occur, whilst, when the cylinders are moved axially away from each other to work the parts of the tights with continuous motion, the pin is completely released from the seat.

During working with continuous motion, the pin and the seat are spaced apart from each other so as to leave free the passage of the fabric of the leg pieces of the pantyhose during their formation, whilst the pin inserted in the seat does not prevent the passage of the fabric of the body during the reciprocating motion as, in this phase of working the pantyhose, the fabric of the body is formed as two borders of fabric joined together at respective ends according to two columns of stitches that, in the knitting phase, pass at opposite sides of the pin, as it will be clearly apparent from the description below.

Further advantageous characteristics and embodiments of the method, of the machine, and of the garment according to the present invention are described hereunder with reference to an example of embodiment and in the appended claims, which form an integral part of the present description.

BRIEF DESCRIPTION OF THE DRAWINGS

The invention will be easier to understand by means of the description below and the attached drawing, which shows a non-restrictive practical embodiment of the invention.

More in particular, in the drawing:

FIG. 4 shows a side perspective view of the pantyhose shown in FIGS. 2 and 3, as it presents itself when it falls from the machine;

FIG. 4A shows a view similar to the view of FIG. 4 in a modified embodiment;

FIG. 5 is a sectional view according to V-V of the tights of FIG. 4;

FIG. 9 shows a view similar to that of FIG. 7 with the machine forming stitch with the lower cylinder;

FIG. 10 shows an enlarged view of a sinker 17;

DETAILED DESCRIPTION OF EMBODIMENTS OF THE INVENTION

Hereinafter a knitting method is described for producing a pantyhose with a body and two leg pieces that can end with feet portions with closed toe or open toe that is subsequently sewn outside of the machine. However, the method according to the present invention can be also used to knit other types of garments, for example briefs or the like, wherein the leg pieces are reduced only to small portions of fabric surrounding the aperture for the legs near the inguinal area.

Furthermore, a particularly advantageous process will be described hereunder wherein whilst knitting the body an arc of needles is excluded to form a crotch area, i.e. a joining area between body and leg pieces, which is not point-like as in the process known from the U.S. Pat. No. 4,011,738. However, it should be understood that in less advantageous embodiments of the present invention, the entire circular needle bed (therefore a 360° arc) of the two cylinders can be used also for knitting the body. In this case the advantage is anyhow obtained of knitting the body with a stitch density equal to the maximum density allowed by the fineness of the machine and equal to the stitch density of the leg pieces or legs, using preferably at least two feeds with "S" yarns and "Z" yarns respectively.

Figure 1:
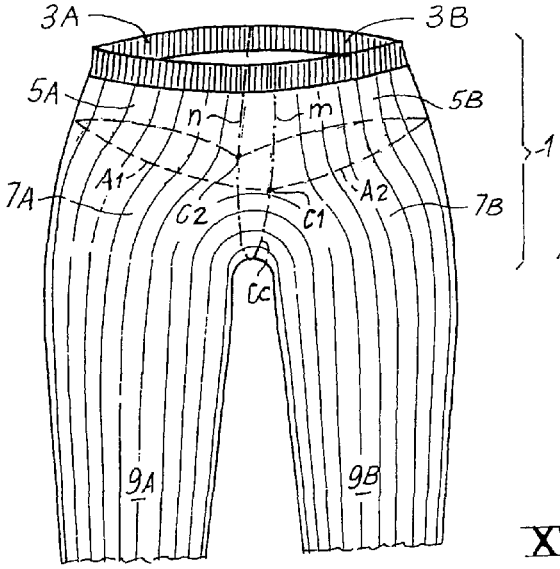
FIG. 1 shows a perspective view of a pantyhose according to the present invention.

FIG. 1 shows a partial schematic perspective view of a pantyhose according to the present invention, wherein some geometrical elements are highlighted, important for understanding the tights knitting method. Knitting is carried out by a double-cylinder machine, i.e. a machine with two superimposed and coaxial cylinders, each with a circular needle bed, the needles of a cylinder being opposite to the needles of the other cylinder.

In particular, in FIG. 1 a body 1 is shown, which comprises an elastic waist band 3A, 3B surrounding the mouth of the garment (pantyhose), an area 5A, 5B (hereinafter indicated as "upper part of the body") suitable to cover the upper part of the pelvis, and an area 7A, 7B (hereinafter indicated as "lower part of the body") which connects the upper part of the body with leg pieces 9A, 9B. The upper part 5A, 5B of the body is knitted with reciprocating motion in a double-cylinder circular knitting machine, the left half 5A (when observing FIG. 1) being knitted on a cylinder and the right half 5B on the other cylinder, these halves being connected along two central ideal lines (m, n), respectively front and back lines, of the pantyhose. In the knitting process the yarn passes along these lines from one to the other of the two circular needle beds of the two superimposed cylinders of the double-cylinder machine, with reversal of the rotational motion. These lines therefore form interstitch lines joining the left and the right portions of the upper part of the body 1.

Conversely, the lower part 7A, 7B of the body 1 and the leg pieces 9A, 9B are manufactured with continuous motion, the left part 7A and the left leg piece 9A on one cylinder of the machine and the right part 7B and the right leg piece 9B on the other cylinder of the machine. Two dotted lines A1, A2 indicate the courses of passage stitches between the upper part 5A, 5B of the body 1, manufactured with reciprocating motion, and the lower part 7A, 7B of the body 1, manufactured with continuous motion. The leg pieces 9A, 9B are mutually joined along a partial arc of stitches CC defining the crotch line of the pantyhose, extending between the end points C1, C2 of join of the lines A1 and A2 and which is formed, practically, by one or more partial courses of stitches, as better described hereunder with reference to the knitting method. These partial courses are obtained with an interknitting formed by the yarns which have formed the upper part 5A, 5B of the body 1 and that are engaged simultaneously by the needles of the two upper and lower cylinders.

In FIG. 1 the pattern of columns of stitches formed by single needles is indicated with continuous lines. As it is shown in this figure, the columns extend from the elastic waist 3A, 3B along the upper part 5A, 5B of the body 1 along the lower part 7A, 7B of the body 1, forming a single tubular fabric, and they subsequently divide to form the two leg pieces 9A, 9B. However, a part of the columns of stitches forming the inner part of the leg pieces 9A, 9B, starts at the line CC formed by the partial joining courses and extending in the crotch area between the points C1 and C2 where the courses A1, A2 meet the lines m and n respectively.

Summarizing, the garment is formed as follows:

- the portion 5A of the upper part 5A, 5B of the body 1, the portion 7A of the lower part 7A, 7B of the body and the leg piece 9A are knitted by one of the two cylinders of the double-cylinder machine;
- the portion 5B of the upper part 5A, 5B of the body 1, the portion 7B of the lower part 7A, 7B of the body and the leg piece 9B are knitted by the other of the two cylinders of the double-cylinder machine;
- the columns of stitches start from the elastic waist and extend to form the leg pieces, except the central ones forming the crotch area and the inner part of the leg pieces, which start from the joining interknitting along the line CC between the points C1 and C2.

Figure 2:
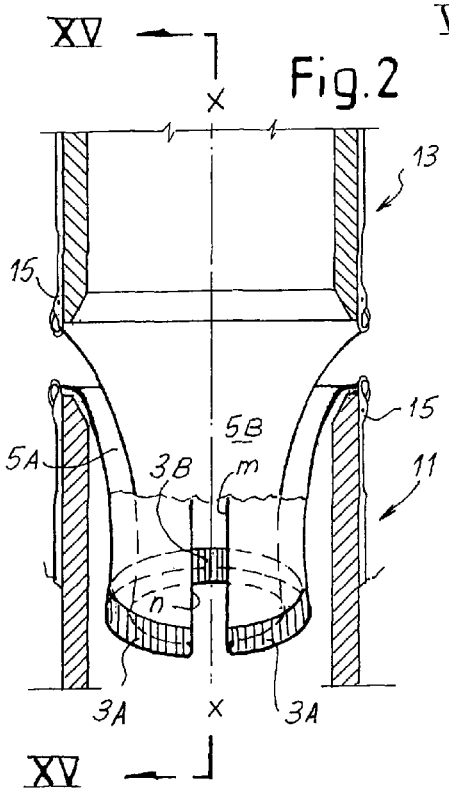
FIGS. 2 and 3 show a partial schematic perspective view of the two cylinders of a circular machine in two knitting phases of the tights of FIG. 1, respectively during the knitting of the panty and during the knitting of the two leg pieces.

FIG. 2 shows the knitting phase of the elastic waist 3A, 3B and of the upper part 5A, 5B of the body 1. In this phase the two cylinders, the lower one 11 and the upper one 13, rotate with reciprocating motion to form with the same yarns, preferably two yarns, in one or more feeds for each cylinder, preferably two feeds for cylinder, the respective halves of the elastic waist band 3A, 3B and of the upper part 5A, 5B of the body 1. When the pair of cylinders rotates in one direction, for example in clockwise direction, the needles of the lower cylinder 11 knit a respective half 3A of the elastic band 3A, 3B or a half 5A of the upper part 5A, 5B of the body 1, whilst the needles of the upper cylinder 13 remain inactive, with the respective hooks lifted at the level of the knocking over plane of the sinkers, and when the pair of cylinders rotates in the opposite direction, i.e. in counterclockwise direction, the needles of the lower cylinder 11 remain inactive with the respective hooks lowered at the level of the knocking over plane whilst the needles of the upper cylinder 13 knit the other half 3B of the elastic waist 3A, 3B or the other half 5B of the upper part 5A, 5B of the body 1.

By reversing the rotational movement of the cylinders, the yarn of each of the feeds forming the elastic waist or the upper part 5A, 5B of the body 1 therefore passes from the needles of one cylinder to the needles of the other cylinder, forming in the motion reversal points at the ends of the respective courses an interstitch with length as smaller as much the two cylinders are axially adjacent to each other. These points of motion reversal define the mentioned central lines (m, n) for joining the two halves 3A, 3B of the elastic waist and the two halves 5A, 5B of the upper part of the body 1.

It should be noted that in this phase not all the needles of the cylinders 11 and 13 are active. In each cylinder an arc of contiguous needles is used corresponding to a preponderant part of the total needles, for example for a cylinder with 400 needles 350 needles are used, forming an arc of contiguous active needles. The remaining needles form an arc C of inactive needles. This occurs both for the cylinder 11 and for the cylinder 13. The needles of the arc C of each of the two cylinders are substantially in the same angular position, i.e. they are mutually opposite. They are inactive, i.e. they remain always out of work, both when the cylinders rotate in clockwise direction and when they rotate in counterclockwise direction. Vice versa, as previously mentioned, the remaining needles, forming the arc complementary to the arc C of inactive needles, work alternatively, the needles of one cylinder when the rotation is in clockwise direction, and the needles of the other cylinder when the rotation is in counterclockwise direction.

There is therefore a substantial difference with respect to the knitting methods described in the patent documents of the prior art mentioned in the introduction of the present description, wherein in the reciprocating motion-knitting phase all the needles both of the upper cylinder and the lower cylinder are set to work, alternatively firstly the ones when the rotation is clockwise and the others when the rotation is counterclockwise. Practically, the waist 3A, 3B and the upper part 5A, 5B of the body 1 can be knitted by using a preponderant part of the needles of each cylinder, for instance 350 needles of a cylinder with 400 needles. In this way the overall number of stitch columns of the elastic waist 3A, 3B and of the upper part 5A, 5B of the body is equal to 700. N5 will indicate hereunder the number of stitches of the upper part of the body 5A, 5B. Nc/2 will indicate the number of needles remained inactive in this knitting phase with reciprocating motion.

After the two halves 5A, 5B of the upper part of the body 1 have been knitted with reciprocating motion with respective end partial courses A1, A2, the phase of knitting the lower part 7A, 7B of the body 1 and subsequently the knitting phase of the leg pieces 9A, 9B (see FIG. 3) starts. Both these phases are carried out with the two cylinders 11, 13 rotating with continuous motion in a same direction, knitting yarns from respective feeds and each producing firstly the respective portion 7A or 7B of the lower part of the body 1 and subsequently the respective leg piece 9A, 9B by means of all their needles (for example 400), i.e. setting to work also the needles previously remained inactive along the arcs C of the two cylinders 11, 13, in a number equal to Nc/2 (=50 in this example).

At the beginning of this phase, also the needles of the arcs C of both the cylinders remained inactive during the reciprocating motion are set to work together with the needles that have knitted the part 3A, 3B of the elastic waist and the upper part 5A, 5B of the body 1. These needles, previously remained inactive, form one or more initial partial courses CC, and continue knitting, with continuous motion, the lower part 7A, 7B of the body 1 and then the leg pieces 9A, 9B together with all the other needles of the respective cylinders. This passage phase will be described in detail hereunder.

The lower part 7A, 7B of the body is therefore knitted with a number of needles equal to the sum of the needles of the two cylinders. Vice versa, each leg piece 9A, 9B is knitted with the needles of a cylinder 11 or 13. Each leg piece will have therefore a number of columns of stitches N9, equal to the number of needles of the cylinder (400 needles in the example). The lower part 7A, 7B of the body will have a number of columns of stitches equal to 2×N9, i.e. equal to the double of the number of needles of each cylinder 11, 13. A part of these columns of stitches extends from the semi-courses A1, A2, which have ended the part knitted with reciprocating motion, towards the leg pieces 9A, 9B, whilst a part of these columns of stitches form the interknitting C, from which they extend towards the leg pieces 9A, 9B. As the number of needles of each cylinder 11, 13 remained inactive during the previous knitting phase with reciprocating motion of the upper part 5A, 5B of the body 1, is Nc/2, therefore the number of columns of stitches involving the interknitting will be equal to Nc.

During knitting, inside the lower cylinder 11, an air flow is generated from the bottom through a traditional intake system not shown in the drawing. In this way the pantyhose, as it is formed, is sucked towards the bottom and moves inside the lower cylinder 11 with the parts 3B of the waist and 5B of the panty and the leg piece 9B inserted inside the corresponding parts 3A, 5A 9A of the pantyhose, so that, when the pantyhose is extracted from the machine, it is in the condition as shown in FIGS. 4 *e* 5 and, to give the pantyhose the wearable form of FIG. 1, it is necessary to extract the right leg piece 9B from the inside of the left leg piece 9A, acting according to the arrow F in FIG. 5, thus also unfolding, after having reversed the leg piece 9B, the right portion 5A of the upper part 5A, 5B of the body and the right part 3A of the elastic waist.

This operation of extracting one leg piece from the other after having knitted the pantyhose can be carried out also automatically on the machine, once the knitting of the tights is ended, by initially detaching only the inner leg piece 9B from the needles 13 that have formed it, and simultaneously reversing the direction of the air flow upwards. In this way, whilst the last course of stitches of the other leg piece 9A is still attached to the needles 15 that have formed it, the inner leg piece 9B is slid out of the outer leg piece 9A and unfolded upwards. At this point, also the last course of stitches of the outer leg piece 9A is detached from the needles 15 and the pantyhose is discharged indifferently upwards or downwards already in the unfolded arrangement of FIG. 1.

Figure 6:
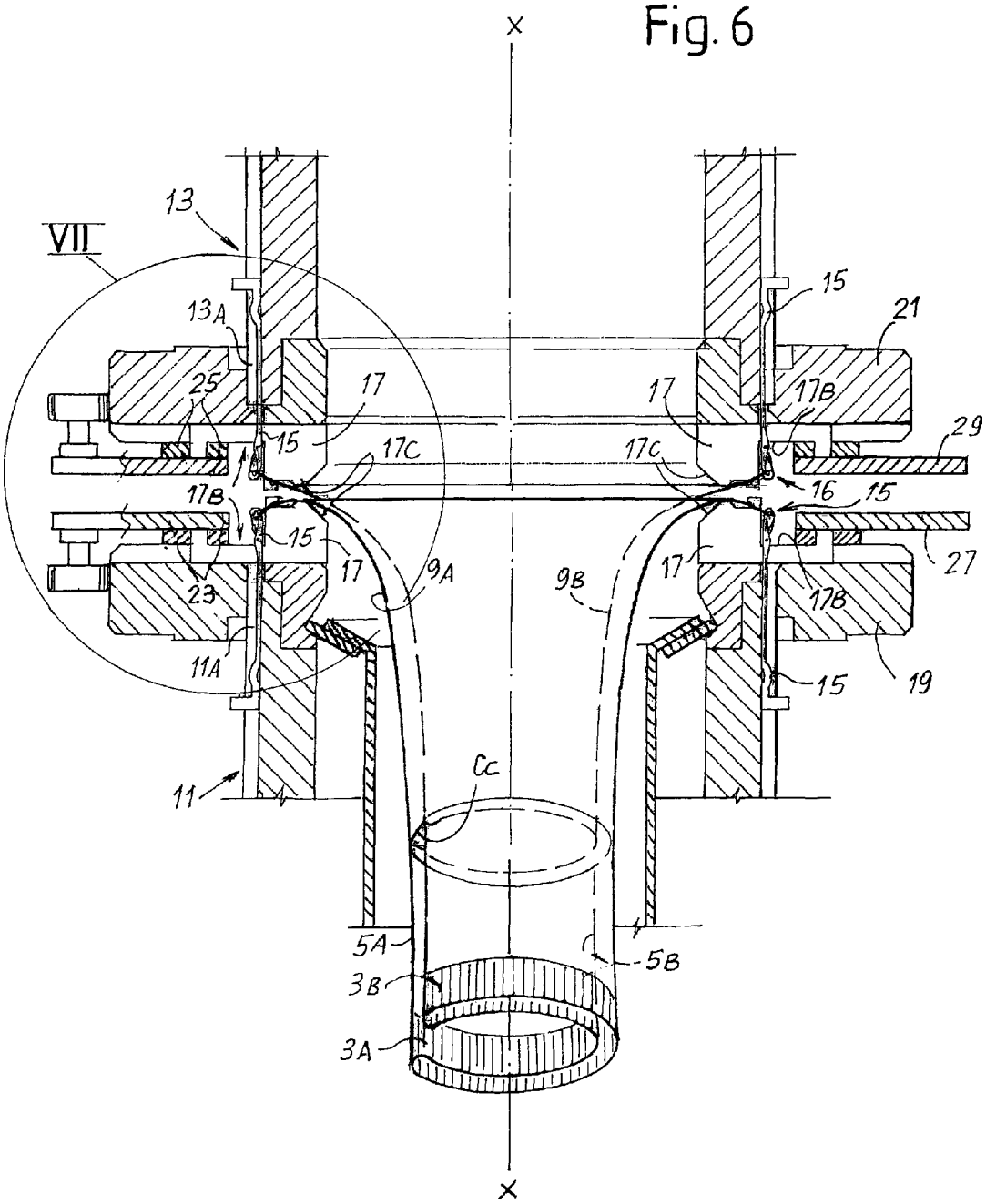
FIG. 6 is an enlarged view of the detail VI of FIG. 3.

FIG. 6 schematically shows an axial section of the facing ends of the lower 11 and upper 13 cylinders of a knitting machine according to the present invention in the reciprocating motion knitting phase of the upper part 5A, 5B of the body 1 of a pantyhose according to the present invention.

In each cylinder the needles 15 can be seen, that slide along an outer longitudinal grooves 11A, 13A of the cylinders under the action of control cams and of underneedles, which will be described hereunder, and the sinkers 17 sliding horizontally in radial grooves of respective plates or "outer rings" 19, 21 integral with the cylinders 11, 13. The sinkers are controlled by cams 23, 25 carried, for each cylinder, by a respective ring 27, 29, which is prevented from rotating by means of specific angular abutments (not shown) of a non rotating part of the machine.

Figure 7:
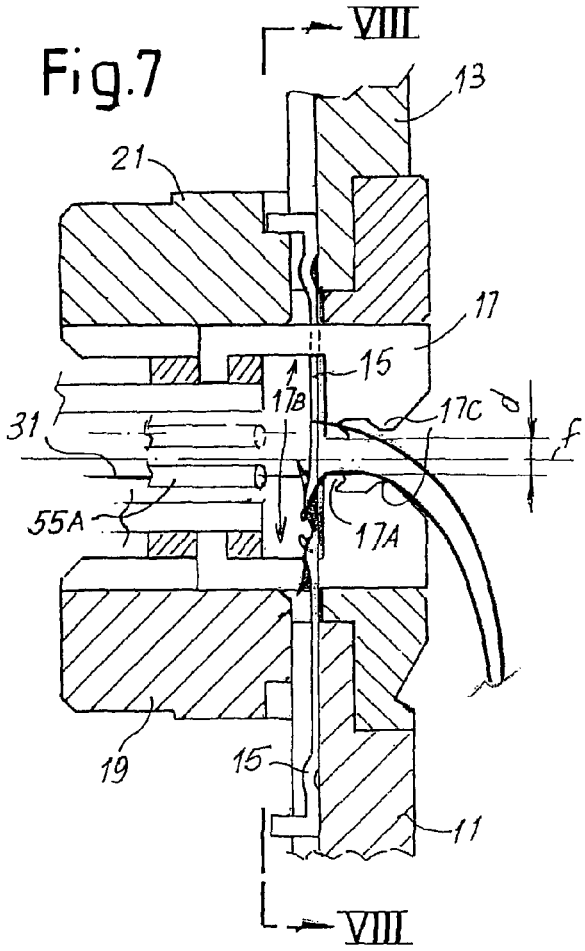
FIG. 7 is an enlarged view of the detail VII-VII of FIG. 6.
Figure 8:
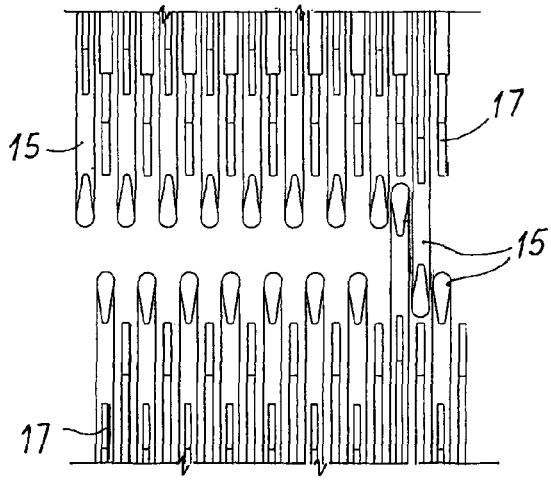
FIG. 8 is a view according to of FIG. 7, in plan development and deformed by extending it horizontally for greater clarity.

In FIG. 8, in which the horizontal distances between needles and sinkers have been increased to make the drawing clearer, it is shown how the needles 15 of the lower cylinder 11 mesh with the needles 15 of the upper cylinder 13, so that the needles 15 of one cylinder are aligned with the sinkers 17 of the other cylinder. Furthermore, in an advantageous embodiment of the present invention, the sinkers 17 have a deep recess 17B (see FIGS. 10, 6, and 7) very near to the respective hook 17A, and practically between the hook and the butt 17T, to allow the passage of the needles 15 of the opposite cylinder when they are make project from said cylinder to pick up the yarns of a feed.

Therefore, in FIG. 7 a needle 15 of the upper cylinder 13 is shown, which has been lowered by making it project from its cylinder 13 passing in the space 17B of the opposite sinker to pick-up a yarn 31 from a yarn guide 55A, whilst the needles of the opposite cylinder 11 are inactive and remain retracted approximately at the level of the upper edge of the sinkers 17 of their cylinder 11. It should be noted that in this phase the yarn guide 55A is slightly above a line (f) indicating the horizontal plane equally distant from the cylinders 11 and 13, so that the needles of the upper cylinder 13 can pick up the yarn in a correct manner. Furthermore, the sinkers 17 of the cylinder, which is not forming stitch, are maintained advanced in the position shown in FIG. 7, so as not to interfere—thanks to the space 17B according to the present invention—with the needles of the upper cylinder when they form stitch.

This arrangement allows working the elastic band 3A, 3B and the upper part 5A, 5B of the body with reciprocating motion with all the needles of an arc of active needles of each cylinder, i.e. using the real fineness of the machine to obtain the required stitch density in the body, as explained above.

FIG. 9 shows the reciprocal position of needles 15 and sinkers 17 when stitch is formed with the lower cylinder 11 to knit the upper part of the body with reciprocating motion. In this phase the needles 15 of the lower cylinder 11 are actuated so as to pick up the same yarn 31 of a feed from the same yarn guide 55A used by the needles of the upper cylinder 13 (FIG. 6) in the previous oscillation. It should be noted that, in the phase of FIG. 9, the yarn guide 55A has been slightly lifted above the line (f) so that the needles of the lower cylinder pick up the yarn in a correct manner. These displacements of the yarn guide 55A between the reciprocating strokes of the cylinders are obtained by means of a specific device, not shown in the drawing, for example of the type shown in the mentioned U.S. Pat. No. 4,011,738.

As during knitting the elastic waist 3A, 3B and the upper part 5A, 5B of the body 1 with reciprocating motion it is necessary, as explained above, that the distance between the two facing cylinders is as small as possible, to reduce as much as possible the interstitch joining the ends of the courses formed by the two cylinders, in a preferred embodiment of the present invention the sinkers 17 have the knocking off plane 17C (FIG. 10) at the same level as the upper part of the respective hook 17A. In this way the cylinders can be maintained adjacent to each other so that the distance (d) (FIG. 7) between the sinkers 17 of the two cylinders 11, 13 is just the one required for the passage of the knitted fabrics.

Figure 11:
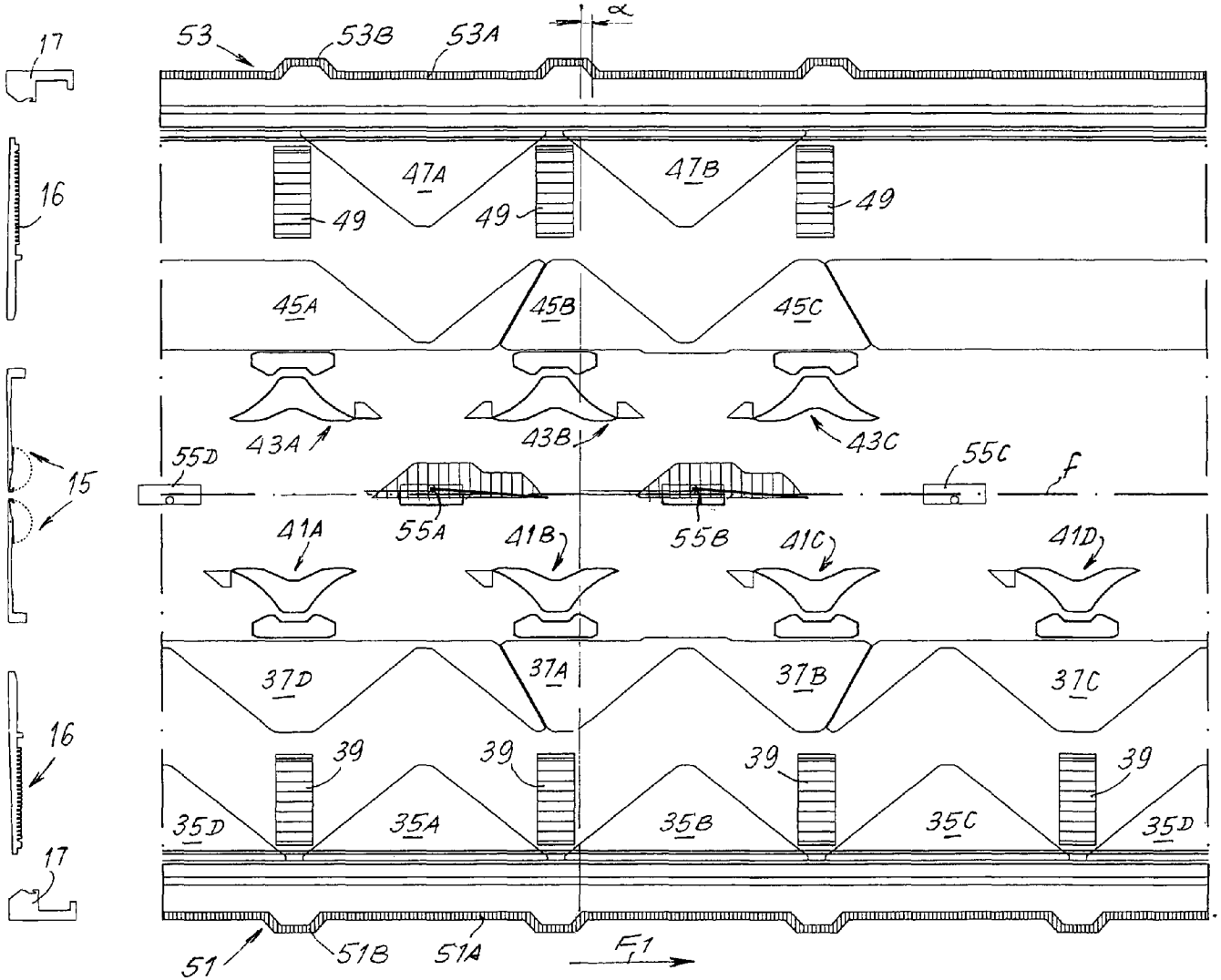
FIGS. 11, 12, and 13 show the plan diagram of the control cams for controlling the needles, the underneedles and the sinkers of the machine of FIG. 2, from the outside, in different working phases.
Figure 12:
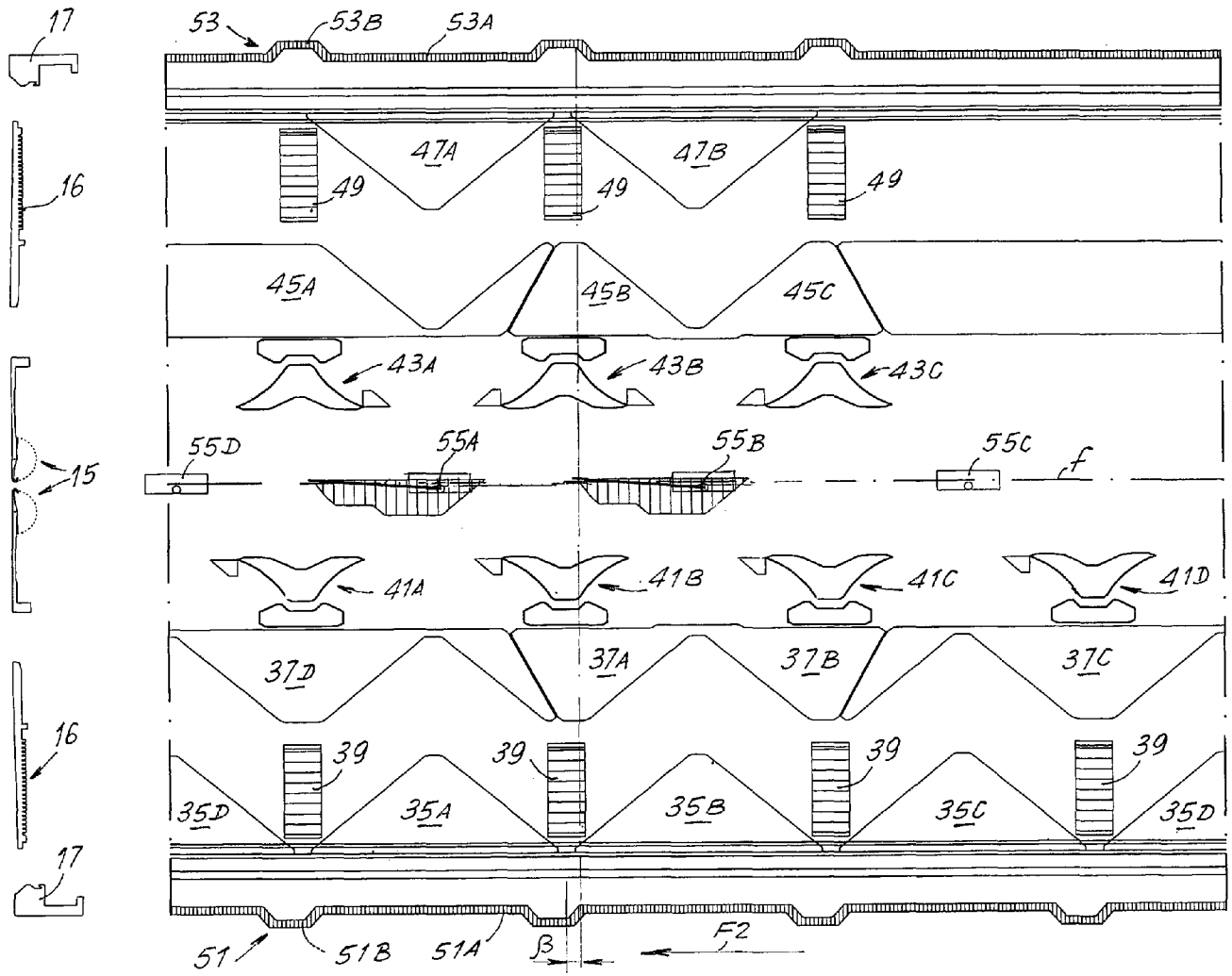
Figure 13:
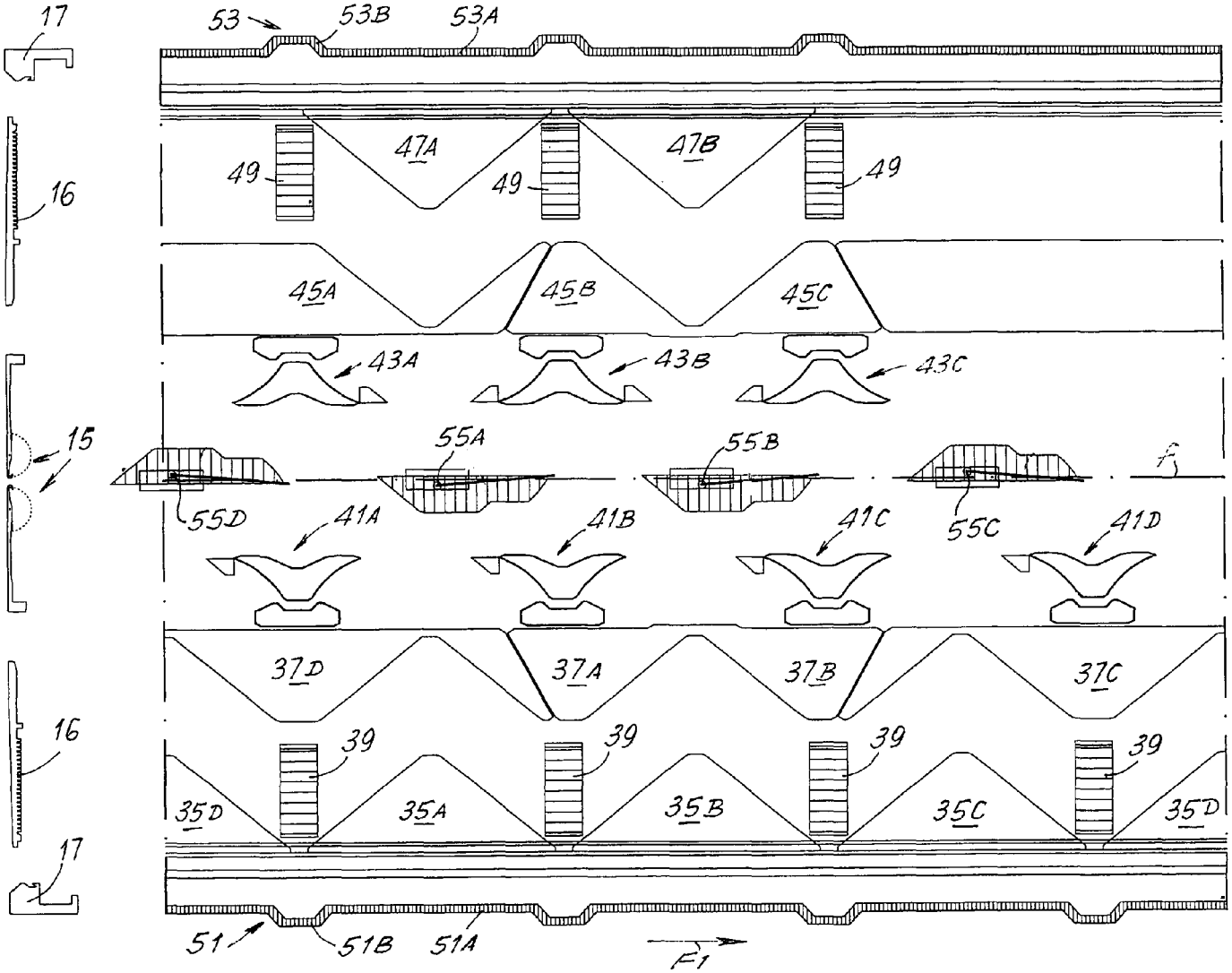

FIGS. 11, 12, and 13 show the development of the set of the handling cams of the needles 15 and of the underneedles 16 of both cylinders in respective working phases of a machine. In the figures, a needle 15 and an underneedle 16 are shown, for the sake of clarity, on the left of this development at the respective work tracks. Starting from the bottom, for the lower cylinder lifting cams 35A, 35B, 35C, 35D and lowering cams 37A, 37B, 37C, 37D can be seen for lifting and lowering the underneedles 16, packs of selection levers 39 that can be controlled in the classic manner through any known mechanical or electrical selecting device, four groups of needle control cams 41A, 41B, 41C, 41D for stitch forming, and for the upper cylinder similar elements can be distinguished, such as three groups of control cams of the needles for forming stitch 43A, 43B, 43C, lifting cams 45A, 45B, 45C and lowering cams 47A, 47B for lifting and lowering the underneedles 16 and packs of selection levers 49.

Respectively above and below the development of the needle and of the underneedle control cams the paths 51, 53 of the heels 17T of the sinkers 17, respectively of the upper cylinder and of the lower cylinder, are shown, which extend at the same plane as the needle control members, to show the movements thereof relative to these latter. However, it should be noted that actually the sinkers 17 move along a horizontal plane, whilst the needles and the underneedles move vertically in the respective grooves of the cylinders of the machine.

In the longer horizontal segments 51A, 53A of sinker paths so represented, the sinkers are in the completely advanced position shown in FIG. 6. This position allows the corresponding needles 15 of the other cylinder to axially project outside the cylinder to pick up the yarn without hitting the sinkers. Instead, the smaller horizontal segments 51B, 53B of these paths represent the sinkers 17 in the completely extracted position in the centripetal direction, as the sinker of the lower cylinder shown in FIG. 9, and traditionally they correspond to the stitch forming cams 41A-41D and 43A-43C of respective feeds of the machine.

Furthermore, in FIG. 11 (and similarly in FIGS. 12 and 13), near the line (f) the paths are shown of the needles corresponding to the feeds which are active in the phase to which the figure refers, paths in which, in this case, the needles 15 of the lower cylinder 11 form stitch by picking up the yarn from yarn guides 55A, 55B.

In the phase of FIG. 11 the cylinders make a counterclockwise rotation (arrow F1) to form on respective yarn feeds 55A, 55B, through an arc of adjacent needles (for example 350 needles out of the overall 400) of the lower cylinder, two courses of stitches of the half 3A (see also FIG. 1) of the elastic waist or of the half 5A of the upper part of the panty. In this phase groups of stitch forming cams 41B, 41C and the corresponding underneedle lifting cams 35A, 35B are used, whilst the needles 15 of the upper cylinder remain inactive being lifted with the hooks at the level of the knock over plane of the respective sinkers 17 as in FIG. 9. The sinkers 17 of the lower cylinder follow the path indicated in FIG. 11, cooperating in a usual manner with the needles forming stitch on said groups of cams 41B, 41C, whilst the sinker control cams of the upper cylinder have rotated counterclockwise by an angle ($\alpha$), to delay the centripetal movement of said sinkers to an extent sufficient not to hinder the needles of the lower cylinder during the stitch formation. This limited rotation of the sinker cams of the upper cylinder in a counterclockwise direction is obtained simply by making the support 29 (FIG. 6) of these cams rotate by friction until an angular abutment not shown in the drawing.

In the phase of FIG. 12, the cylinders make a rotation in the clockwise direction (arrow F2) to form, with the upper cylinder by means of an arc of adjacent needles (for example 350 needles out of the overall 400) and on the respective yarn feeds 55A, 55B already used in the phase of FIG. 11, two courses of stitches either of the half 3B (see also FIG. 1) of the elastic band or of the half 5B of the upper part of the panty. In this phase groups of stitch forming cams 43A, 43B and the corresponding lowering cams 47A, 47B and lifting cams 45A, 45B for lowering and lifting the underneedles are used. The sinkers 17 of the upper cylinder follow the path shown in FIG. 12, cooperating in a usual manner with the respective needles 15, which form stitch on said groups of cams 43A, 43B, whilst the control cams of the sinkers of the lower cylinder have been made rotate in clockwise direction delaying by an angle ($\beta$) the centripetal movement of the respective sinkers to an extent sufficient not to hinder the needles of the upper cylinder during the above mentioned stitch formation. This limited rotation of the sinker cams of the lower cylinder in a clockwise direction is obtained simply by making the support 27 of said cams rotate until a provided angular abutment.

In the phase of FIG. 13, the cylinders rotate in counterclockwise direction with continuous motion (arrow F1) to form each either a respective half 7A, 7B of the lower part of the panty or a respective leg piece 9A, 9B, working in both the cases with all the their needles. In particular, in this phase the lower cylinder forms, at each rotation, two courses of stitches picking up the yarn from yarn guides 55D, 55C through the groups 41A, 41D of stitch forming cams and the corresponding underneedle lifting cams 35D, 35C, whilst the upper cylinder forms two courses of stitches by picking up the yarn from yarn guides 55A, 55B by means of the groups 43B, 43C of stitch forming cams and the corresponding underneedle lowering cams 47A, 47B. The sinkers 17 both of the upper cylinder 13 and of the lower cylinder 11 move along the path shown in FIG. 13, cooperating in a usual manner with the respective needles 15 forming stitch on said groups of cams 43B, 43C; 41A, 41D without reciprocal offset of the respective control cams as the two cylinders, as it is clearly shown in FIG. 10, form stitch on mutually angularly offset feeds, therefore without interferences of the sinkers of one cylinder with the needles of the other cylinder, thanks to the particular shape of the sinkers according to the invention, as explained above.

At the beginning of the continuous motion knitting phase, involving all the needles of the two cylinders, i.e. both the needles that have formed with reciprocating motion the waist 3A, 3B and the upper part 5A, 5B of the body 1, the needles along the arc C of inactive needles of the two cylinders 11, 13 are devoid of stitches on their shank, as they did not participate in the previous knitting phase. At the beginning of the continuous motion knitting phase these arcs C of needles remained inactive during the previous phase form, at the beginning of the knitting with continuous motion, the course or the courses for joining the leg pieces along the crotch line CC (see also FIG. 1). To be set to work, these needles must engage at least one yarn to form a first course of stitches.

Figure 14:
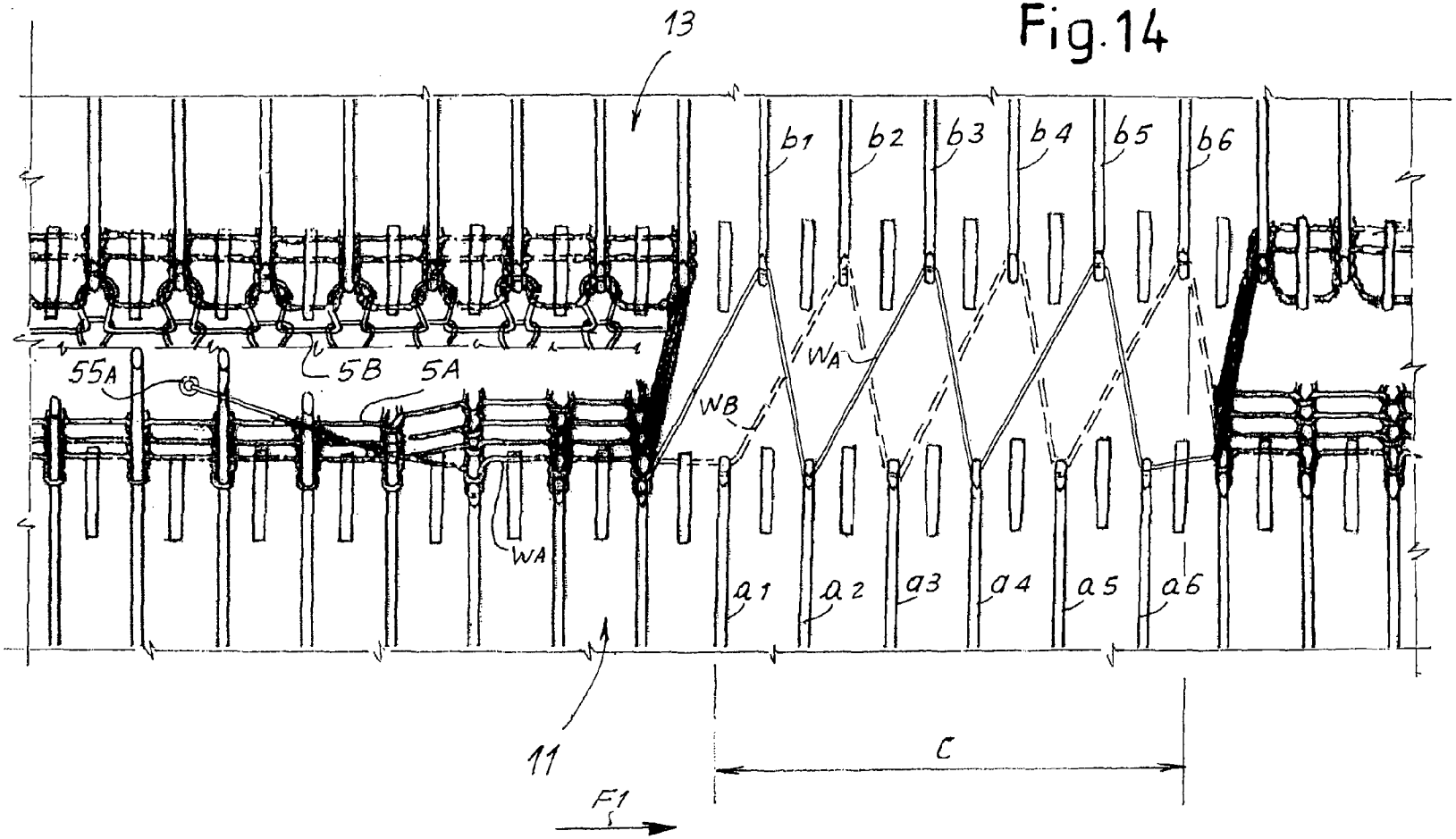
FIG. 14 shows a view according to VIII-VIII of FIG. 7 in the phase of formation of the joining course between the leg pieces.

FIG. 14 shows the formation of the first course of stitches formed with a first yarn $w_A$ of this phase. In the illustrated example, as the yarns having formed the upper part 5A, 5B and the elastic band 3A, 3B of the body 1 are that of the yarn guides of the lower cylinder 11, the first yarn $w_A$ (that is one of those having formed the part 55A, 55B of the body 1) is engaged by the needles of the lower cylinder 11. These needles pick up the yarn from the yarn guide 55A of the feed 41B (see also FIG. 13). A second course of stitches is formed with another yarn $w_B$ (that has also formed the part 55A, 55B of the body 1) fed by the yarn guide 55B of the feed 41C, as described hereunder.

When, during the formation of the first course ($w_A$), the arcs of needles C previously remained inactive of both the cylinders 11, 13 (whose latch has been previously opened by means of a common needle opening device, not shown in the drawing) pass in front of the yarn guide 55A, to pick up this yarn needles in odd position (b1, b3, etc.) of the upper cylinder and needles of even position (a2, a4, etc.) of the lower cylinder are actuated. In this way at the arc C of needles the yarn $w_A$ is arranged in a zigzag as shown in FIG. 14. By continuing the rotation of the cylinders in the direction F1, at the subsequent feed, i.e. at the feed 41C of FIG. 13, the needles of the arcs C of the two cylinders 11, 13 pick up the yarn $w_B$ carried by the yarn guide 55B with an inverted selection relative to that shown in FIG. 14, i.e. they are actuated so as to pick up the yarn only from the odd needles (a1, a3, etc.) of the lower cylinder 11 and the even needles (b2, b4, etc.) of the upper cylinder 13. In FIG. 14 the path of the yarn $w_B$ engaged by the even needles of the upper cylinder 13 and by the odd needles of the lower cylinder in this phase is indicated with a broken line.

In this way two mutually interknitted initial courses of stitches are formed at the arcs of needles, and afterwards all the needles of the arc C of both the cylinders 11, 13 can work together with all the other needles of the two cylinders, as illustrated and described in FIG. 13, to knit both the lower part 7A, 7B of the body 1 and the respective leg pieces 9A, 9B. These present a joining interknitting along the arched curve CC at the crotch.

In the above description it has been assumed that the body is knitted with reciprocating motion using two lower feeds and two upper feeds with two working yarn guides 55A, 55B of the lower cylinder. Consequently, the initial courses of the interknitting formed by the arc C of needles inactive in the previous phase on each cylinder 11, 13, which are set to work when the reciprocating motion knitting ends and the continuous motion knitting starts, are obtained with the same lower yarn guides which feed the yarns $w_A$, $w_B$, with which the upper part 5A, 5B of the body 1 has been knitted. However, it is possible to operate in a reversed manner, i.e. forming the body 1 feeding two yarns with yarn guides of the upper cylinder. In this case, the interknitting will be formed by two yarns $w_A$, $w_B$, which have been fed by the yarn guides of the upper cylinder to both the cylinders in the reciprocating motion knitting phase to form the upper part 5A, 5B of the body 1.

It is also possible to obtain this interknitting also with reciprocating motion, but this solution is more complex and less quick.

During the reciprocating motion it is therefore necessary to maintain the two cylinders exactly phased with each other with the respective needles offset by half a step. This can be obtained in a usual manner producing the transmission of motion between the cylinders with rectified gears and by recovering at the assembly stage the inevitable clearance of the transmission by using doubled gears. This is however very expensive.

To overcome this drawback, in some embodiments of the present invention a particular arrangement is provided, illustrated in FIGS. 15 to 19, wherein a hollow block 103 is fixed by means of screws 101 to the lower cylinder 11, said block being provided with an upper hole inside which a cylindrical bushing 105 is forced. The axis Y-Y of the bushing is parallel to the axis X-X of the cylinders and arranged inside and near the needles forming the crotch C of the pantyhose, equally distant from the needles, at which the inversion of the knitting motion occurs and which form the columns of stitches m, n of FIG. 1.

A similar hollow block 109 is fixed by means of screws 11 to the upper cylinder 13, said block inferiorly having a hole inside which an angular reference plug 107 is forced, which also has an axis Y-Y. The plug 107 can be inserted in the bushing 105 with a minimum radial clearance only sufficient for the free reciprocal axial sliding.

Figure 3:
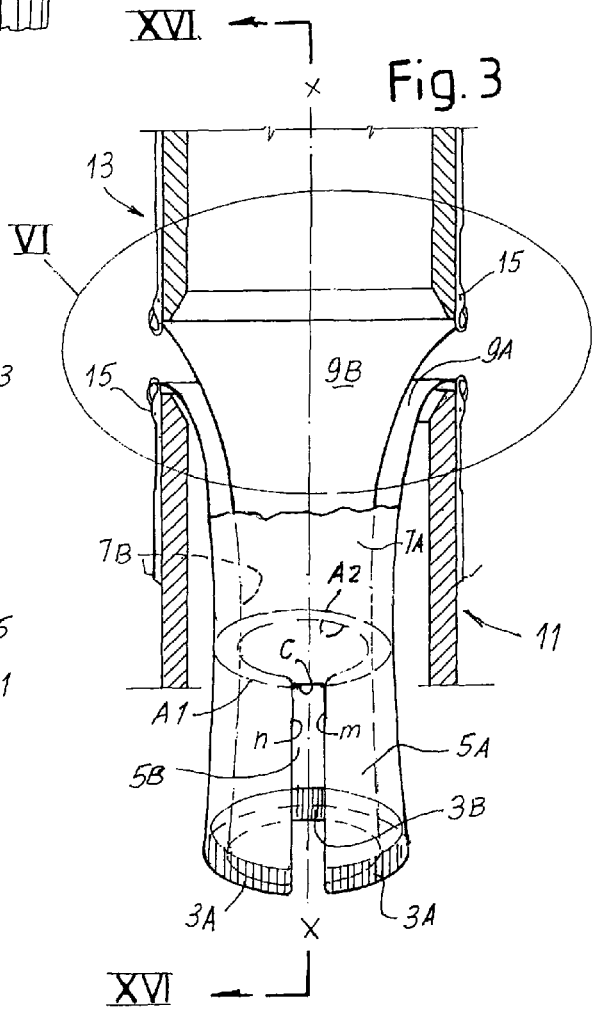
Figure 15:
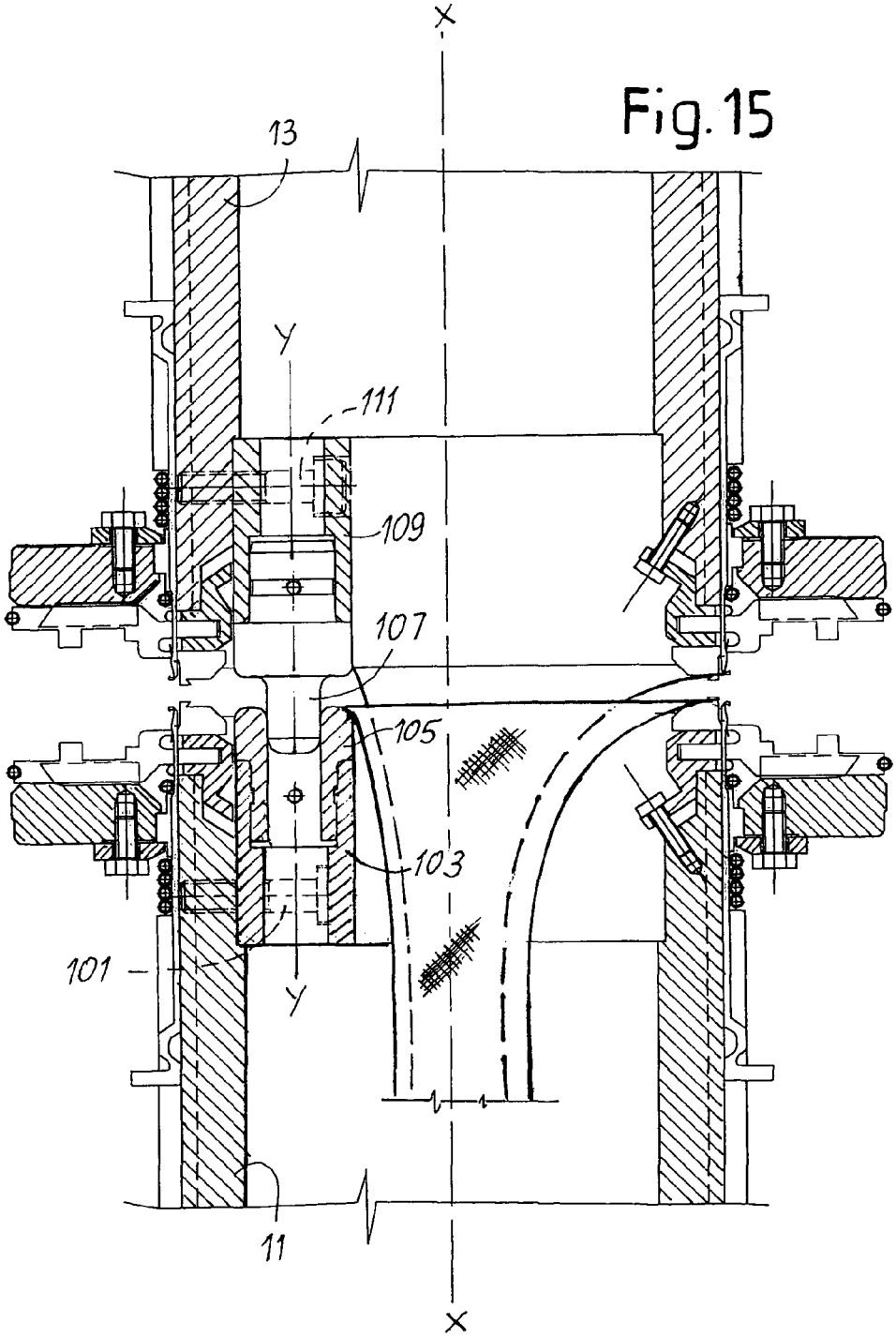
FIGS. 15 and 16 show axial sectional views of a machine according to an embodiment of the present invention with the cylinders respectively moved axially toward and away from each other.

In the arrangement of FIG. 15 the cylinders are adjacent to each other as much as possible for knitting with reciprocating motion the parts 5A, 5B of the body and 3A, 3B of the elastic waist. In this arrangement the plug 107 is inserted with a minimum clearance in the seat 105, so as to keep the cylinders 11, 13 in angular alignment to each other, in such a manner that the needles of one cylinder, when they are actuated to form stitch, freely insert between the needles of the other cylinders without reciprocal interference, as shown in FIG. 8. The two edges 3A, 5A; 3B, 5B of fabric manufactured with reciprocating motion move one inside the other as shown in FIGS. 2 and 3 and are joined together at respective ends according to the lines m, n. Thanks to the arrangement of the above described plug 107, it does not interfere with these two edges of fabric during the formation thereof, as they pass at opposite sides of the plug 107 without interfering with it.

In this way any angular clearance resulting from the mechanical transmission between the cylinders 11 and 13 is recovered, in particular the clearance the gears and of any joint forming it, and it is not necessary to use rectified gears.

Figure 16:
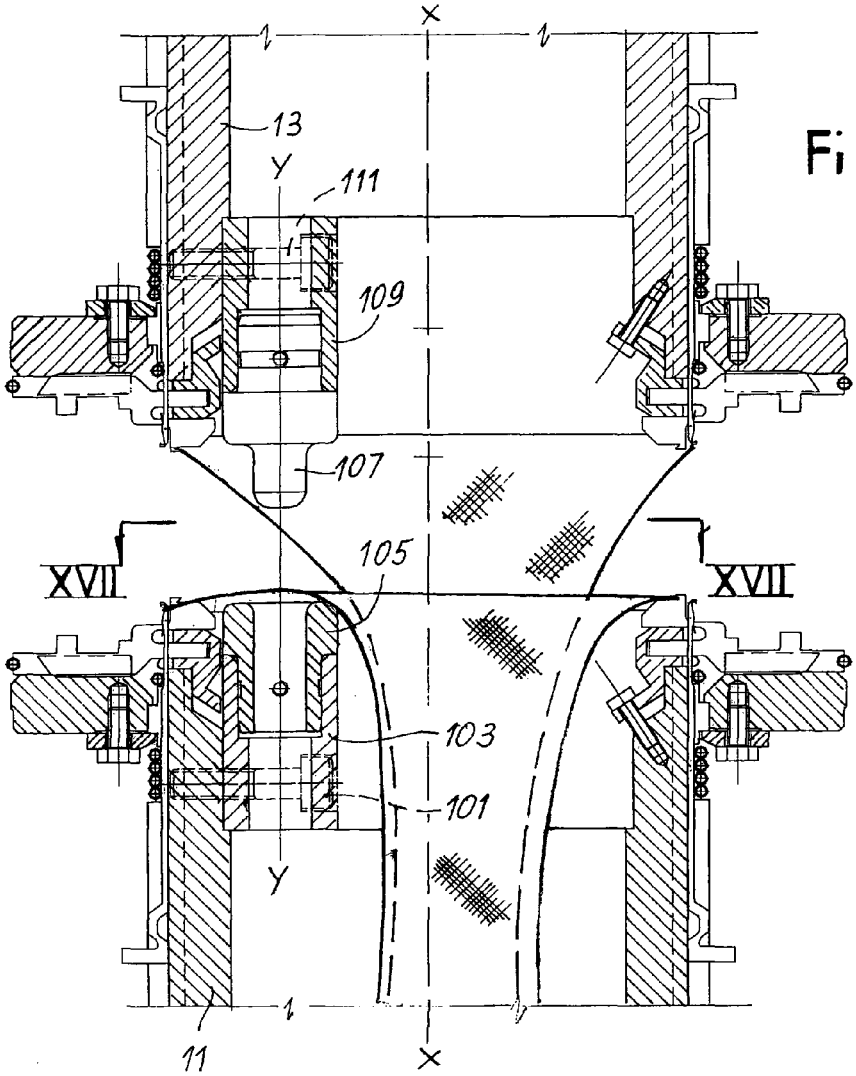
Figure 17:
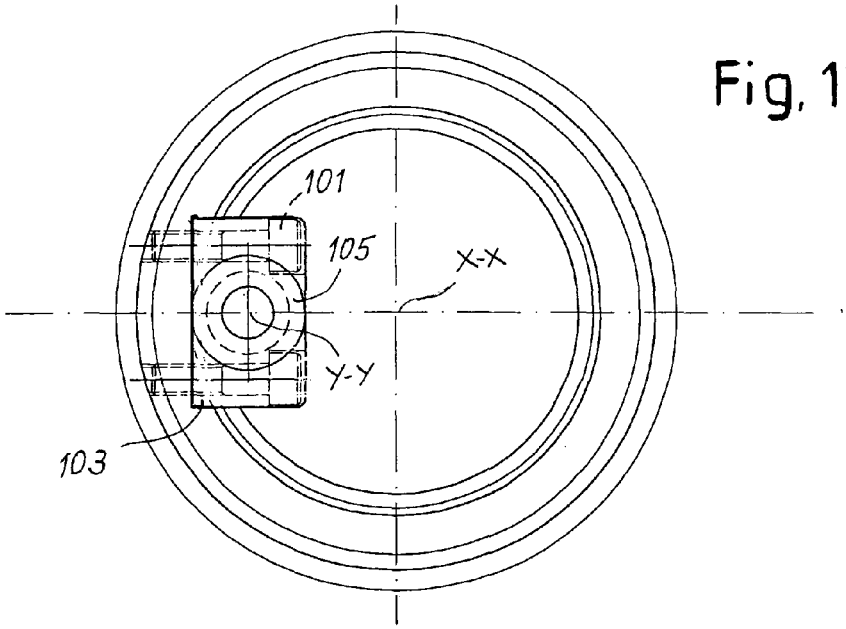
FIG. 17 shows a sectional view according to XVII-XVII of FIG. 16.

In the arrangement of FIG. 16, in which the mutual axial position of the cylinders 11, 13 is shown while working with continuous motion the leg pieces 9A, 9B, the cylinders are distanced from one another so that the respective needles, when actuated to form stitch, remain axially spaced from the needles of the other cylinder, and therefore an accurate relative angular positioning thereof is not necessary. In this position the plug 107 is completely extracted from the seat 105 and remains spaced from it to an extent sufficient to allow the passage between plug and seat of the fabric of the leg pieces 9A, 9B during the knitting thereof.

Figure 18:
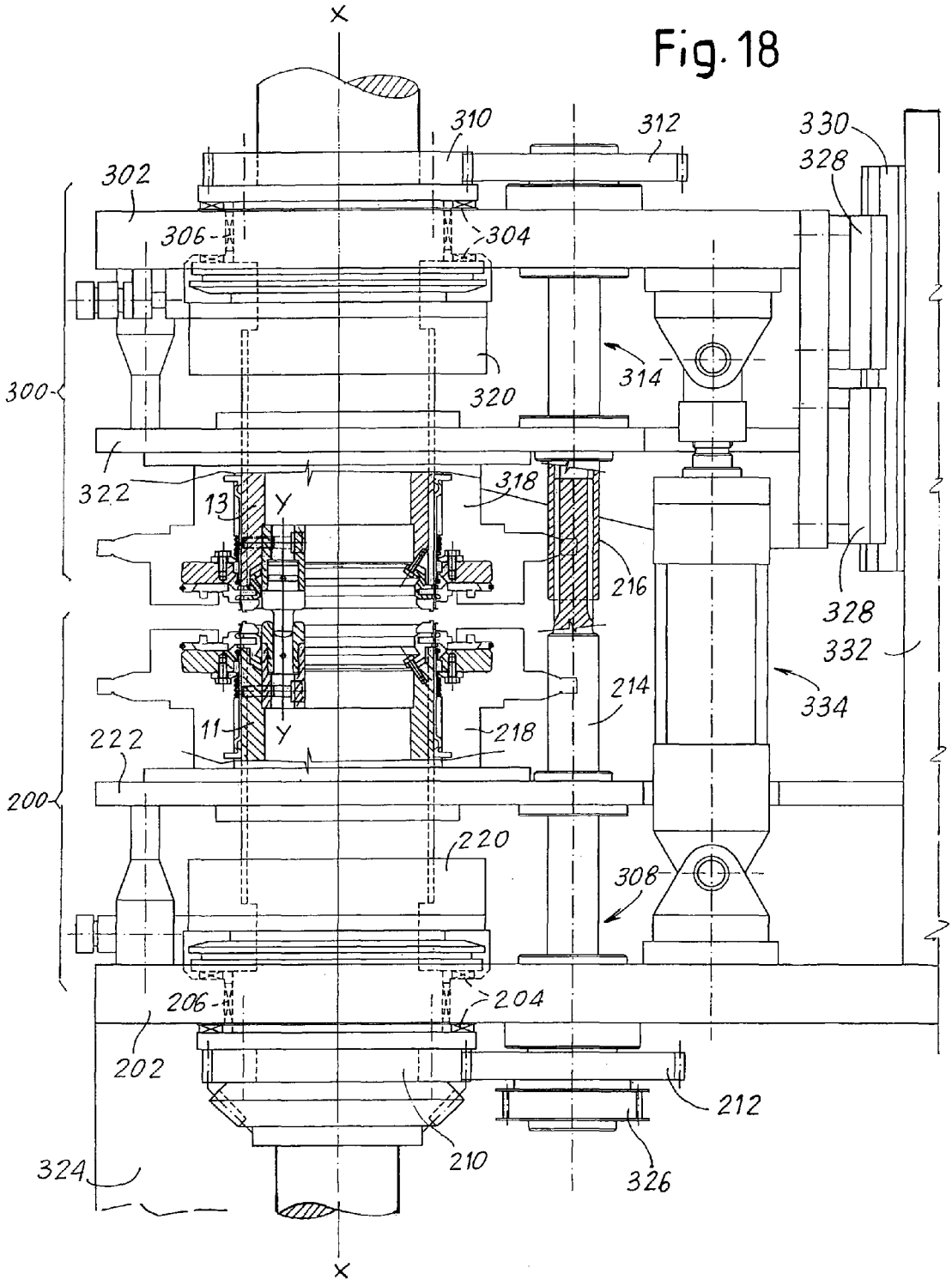
FIGS. 18 and 19 show sectional schematic views of the head of a machine that uses the two cylinders of FIG. 15 and the following, in an arrangement with the cylinders axially adjacent to each other and in an arrangement with the cylinders axially moved away from each other, respectively.

FIG. 18 shows a side view of the head of the above described double cylinder machine, with the lower cylinder 11 and the upper cylinder 13 in the adjacent arrangement of FIG. 15. Practically, the machine has two opposite semi heads 200, 300, each of which comprises a base plate 202, 302, which supports the respective cylinder 11, 13 by means of bearings 204, 206, 304, 306. The cylinders are connected to each other by means of a drive shaft 308 and two respective pairs of gears 210, 212; 310, 312, the drive shaft being actually formed by two coaxial shafts 214, 314 joined together by a joint with splined profiles 216 that can slides axially.

Each head 200, 300 furthermore comprises control cams for controlling the respective needles and underneedles (not shown in the drawing), cams that are applied to supports called "mantles" 218, 220; 318, 320 fixed to an intermediate plate 222; 322 and to the base plate 202, 302, respectively.

The lower base plate rests on the base 324 of the machine and the head receives the motion for the rotation of the cylinders by means of a toothed belt and a pulley 326.

The upper semi head 300 has the base plate 302 integral with shoes 328 of a prismatic guide 330 parallel to the axis X-X of the cylinders and fixed to a lateral support, which is in turn integral with the base plate 202 of the lower semi head 200. A pneumatic actuator 334 is interposed between the base plates 202, 302 of the two semi heads, to move them towards or away from each other, the displacement run being defined by adjustable abutments (not shown).

Figure 19:
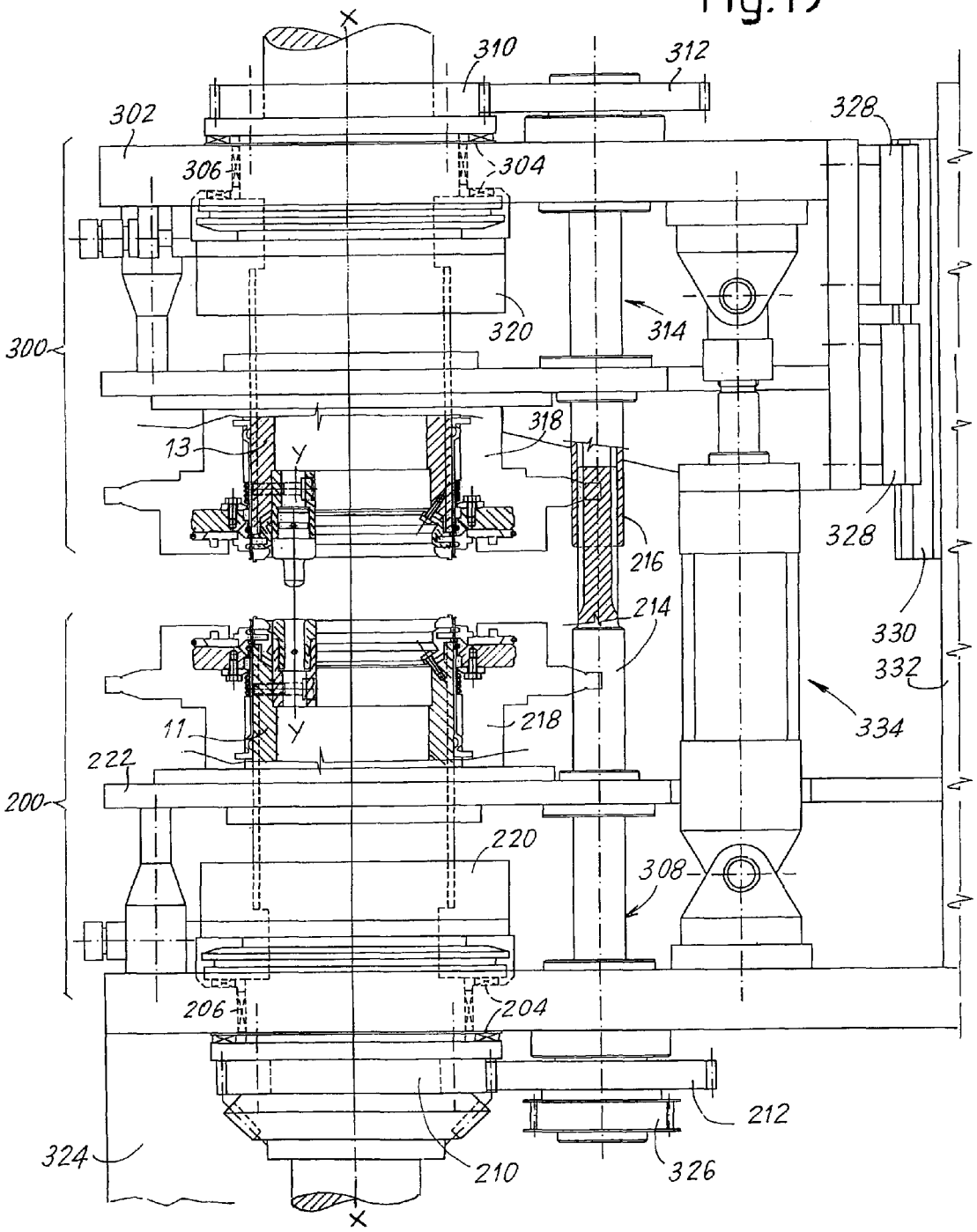

It is therefore possible to move the cylinders 11, 13 towards each other with the relative semi heads 200, 300 in the arrangement of FIG. 18, to knit with reciprocating motion parts of the pantyhose according to the method described above, or move said cylinders away from each other together with said semi heads in the arrangement of FIG. 19 to knit with continuous motion the other phases of the pantyhose.

Figure 1A:
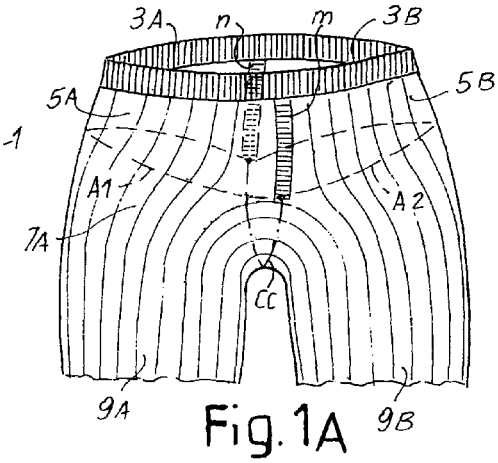
FIG. 1A shows a view similar to FIG. 1 in a modified embodiment.

It should be understood that the reciprocal axial movement of the two cylinders towards each other with the needles of one cylinder inserting between the needles of the opposite cylinder in the knitting phase with reciprocating motion is particularly advantageous, as it allows to obtained a more regular finished article, wherein the area of the body obtained at the reversal of the motion of the cylinders is practically not visible. However, it is also possible to maintain the cylinders spaced from each other also during the reciprocating motion knitting phase of the body. In this case less mechanical complications occur, with a lower quality of the finished fabric. FIGS. 1A and 4A schematically show views of the garment similar to that of FIGS. 1 and 4, but with the indication of a wider interstitch line m, n, i.e. the presence of an area wherein two adjacent columns of stitches are more spaced reciprocally, due to the fact that in this area the yarn is passed from a cylinder to the other performing a greater displacement than in the case of adjacent cylinders, due to the greater distance at which these cylinders are maintained during all the knitting process.

Above an embodiment has been described in detail, wherein an arc of needles remain inactive whilst knitting the body with reciprocating motion, said needles being set working operation to form an interknitting in a closing area of the crotch. In this way it is possible to obtain an article of high quality and better fit, substantially improved relative to what can be obtained with methods according to the prior art. In particular, the article has a significantly greater stitch density in the area of the body than that which can be obtained with the traditional systems, wherein the body is knitted only with half of the needles of the cylinders, i.e. maintaining active for each of the cylinders only the even needles or only the odd needles. Maintaining inactive only the needles at the interknitting C, which correspond only to a fraction of the needles of the entire circular needle bed, the number of columns of stitches of the portion of the body knitted with reciprocating motion is significantly greater than the number of columns of stitches of a single leg piece. For example, if a fourth of the needles of each circular needle bed, i.e. of each cylinder, is excluded from working during the reciprocating motion knitting step, the body is knitted (in the part formed by reciprocating motion) with a number of stitch columns equal to 1.5 times the number of stitch columns of a leg piece. Typically, the number of needles excluded from working in the reciprocating motion phase is however lower than the 25% of the overall needles. For example, on a machine with 400 needles, 50 needles can be excluded from work during reciprocating motion knitting, and therefore the interknitting C is formed by 50 needles per cylinder, whilst the part of the body knitted with reciprocating motion is formed by 2*(400–50)=700 needles.

Figure 20:
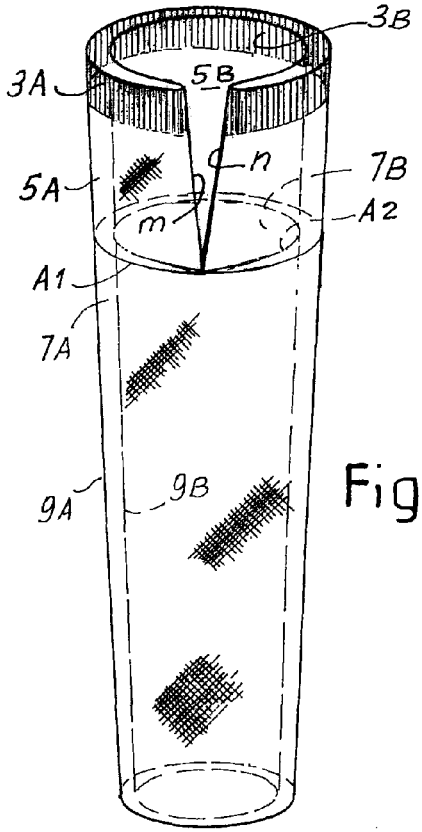
FIG. 20 schematically shows, in an intermediate working phase analogous to that of FIG. 4, a pantyhose formed with the method and the machine according to the present invention in a modified embodiment, wherein whilst knitting the body all the needles are used on a 360° angular development of the two cylinders.
Figure 21:
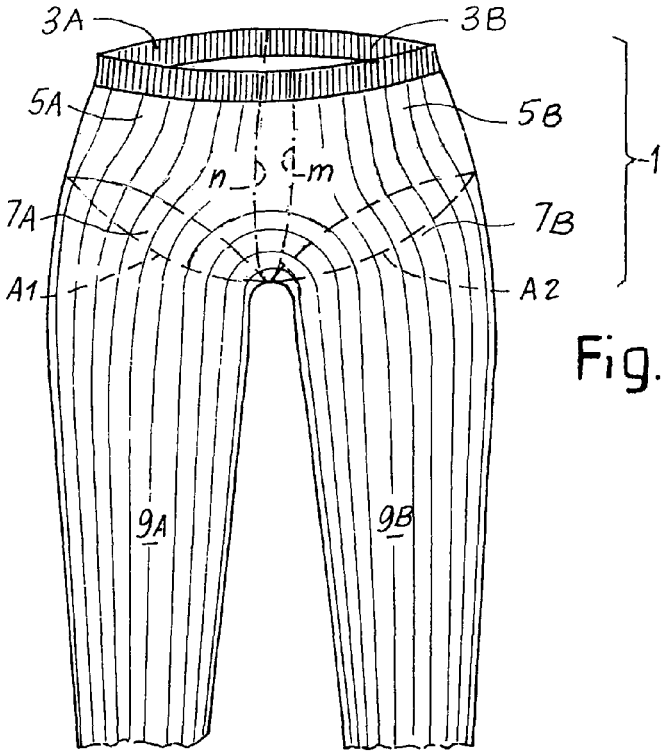
FIG. 21 shows the pantyhose of FIG. 20 in the stretched and opened arrangement, corresponding to FIG. 1.

In less advantageous embodiments of the present invention is it possible to provide for knitting the body with reciprocating motion by using all the needles (and not alternate needles as in the prior art) on all the circular needle bed of both the cylinders, i.e. using the needles on all the 360° of the needle beds of the two cylinders. FIG. 20 schematically shows an article in an intermediate working phase, corresponding to FIG. 4, in this different embodiment of the present invention. FIG. 21 shows a view of the article similar to that of FIG. 1. The structure of the machine and the knitting phases remain substantially unchanged relative to what described above, but also in the reciprocating motion knitting phase all the needles of the cylinders take part to knitting the stitches. A garment manufactured in this manner comprises an equal number of stitch columns in the two leg pieces, whilst the body is formed, on the entire development thereof, by a number of stitch columns equal to the sum of the columns of stitches forming the leg pieces and therefore with the same stitch density on the entire garment. For example, on a machine with 400 needles, each leg piece is knitted with 400 needles and the body is knitted with 800 needles.

As mentioned, in the introductory part of the description, it is possible to knit the article starting from the toes of the leg pieces, with continuous motion of the two cylinders, and finishing with the waist of the body. Also in this case it is possible to generate the interknitting C, excluding from work an arc of needles on both the cylinders, when passing from knitting the leg pieces to knitting the body. The interknitting can be stabilized or make run-proof for example by using a melt blown yarn, or with a 1/1 interknitting, or with a Lycra fraying, or with other known methods.

It is understood that the drawing only shows an example provided by way of a practical arrangement of the present invention, which can vary in forms and arrangements without however departing from the scope of the concept underlying the invention. Any reference numbers in the appended claims are provided for the sole purpose of facilitating reading of the claims in the light of the description and the drawing, and do not in any manner limit the scope of protection represented by the claims.

The invention claimed is:

1. A method for knitting a knitted garment, comprising a body and two leg pieces, by means of a double-cylinder circular knitting machine with two superimposed cylinders, the method comprising the steps of:

knitting at least one part of the body with reciprocating motion of the two cylinders;

knitting the leg pieces with a continuous rotary motion of the two cylinders, a first leg piece being knitted by a first of said cylinders and a second leg piece being knitted by a second of said cylinders, wherein while knitting the body with reciprocating motion of the two cylinders, all the needles of at least one arc of needles of the upper cylinder and all the needles of a corresponding arc of needles of the lower cylinder are set to work, and at least two feeds and at least two yarns are used.

2. A method as claimed in claim 1, further comprising:

knitting firstly the waist of the body, knitting the body and subsequently knitting the leg pieces.

3. A method as claimed in claim 1, further comprising:

knitting firstly the toes of the leg pieces simultaneously, knitting the leg pieces and subsequently knitting the body.

4. A method as claimed in claim 1, wherein while knitting said at least one part of the body with reciprocating motion, an even number of feeds and yarns is used, with at least one yarn "S" and at least one yarn "Z", and each leg piece is knitted with at least two feeds and at least one "S" yarn and one "Z" yarn.

5. A method as claimed in claim 1, further comprising:

maintaining the needles of an arc temporarily inactive on each of said two cylinders while knitting said at least one part of the body with reciprocating motion; and forming with said temporarily inactive needles an interknitting line for joining the two leg pieces.

6. A method as claimed in claim 5, further comprising:

firstly knitting at least one part of the body with reciprocating motion maintaining the needles of said arc inactive; and;

at the end of the knitting of said at least one part of the body, setting to work said temporarily inactive needles forming the interknitting line for joining the two leg pieces, and then continuing the knitting with continuous rotary motion by means of all the needles of both the cylinders for knitting said leg pieces.

7. A method as claimed in claim 1, wherein:

said garment is formed by joining three tubular fabrics, a first tubular fabric is obtained by means of both the cylinders which rotate with reciprocating motion and work yarns fed by at least two yarn guides of at least two feeds, the needles of one cylinder working when said cylinder rotates in one direction and the needles of the other cylinder working when the other cylinder rotates in the opposite direction;

the other two tubular fabrics are obtained by knitting simultaneously and separately a first of said other two fabrics by means of the first cylinder and a second of said other two fabrics by means of the second cylinder by rotating the first cylinder and the second cylinder with a continuous motion and feeding each of said first cylinder and said second cylinder with at least two respective yarns from two respective yarn guides of at least two feeds for each cylinder.

8. A method as claimed in claim 7, wherein:

in order to work said first tubular fabric, each cylinder uses all the needles of a first arc of needles, having a number of needles lower than the total number of needles of the cylinder, leaving a respective arc of inactive needles for each cylinder;

knitting of each of the other two tubular fabrics is performed by means of all the needles of the respective cylinder.

9. A method as claimed in claim 6, wherein at said arc of needles remained inactive while knitting said first part of the body, said interknitting is formed with at least one partial course and preferably two partial courses of common stitches along a crotch line of the garment, said at least one partial course being knitted by means of the needles of the arcs of needles remained inactive of both the cylinders.

10. A method as claimed in claim 6, wherein at said arc of needles remained inactive while knitting said first part of the body, said interknitting is formed with at least two partial courses of common stitches along said crotch line of the garment, said two partial courses being knitted by means of the needles of the arcs of needles remained inactive of both the cylinders.

11. A method as claimed in claim 9, wherein said at least one partial course is formed with a yarn which has knitted said first part of the body.

12. A method as claimed in claim 10, wherein said at least two partial courses are formed with two yarns which have knitted said first part of the body.

13. A method as claimed in claim 9, wherein said at least one partial course of common stitches knitted by means of the arcs of needles remained inactive while knitting the first part of the body is formed by engaging at least one yarn by means of alternate needles of the arcs of needles remained inactive of the two cylinders.

14. A method as claimed in claim 10, wherein said two partial courses of common stitches knitted by means of the arcs of needles remained inactive whilst knitting the first part of the body are formed by engaging at least one first yarn by means of even needles of the arc of needles remained inactive of the first cylinder and odd needles of the arc of needles remained inactive of the second cylinder and subsequently engaging a second yarn by means of odd needles of the arc of needles remained inactive of the first cylinder and even needles of the arc of needles remained inactive of the second cylinder.

15. A method as claimed in claim 9, wherein said at least one partial course or said two partial courses of stitches are knitted with a continuous and simultaneous motion of rotation of the two cylinders.

16. A method as claimed in claim 1, wherein said first part of the body is knitted by means of at least two yarns fed by two yarn guides alternatively to the first cylinder during the rotation in one direction and to the second cylinder during the rotation in the opposite direction.

17. A method as claimed in claim 1, wherein said first part of the body is knitted using two feeds of the first cylinder and two feeds of the second cylinder.

18. A method as claimed in claim 1, wherein, while knitting with reciprocating motion said at least one part of the body, the two cylinders of the double-cylinder machine are moved axially towards each other in an adjacent work position, so that the needles of one cylinder penetrate between the needles of the other cylinder, and while knitting with continuous rotary motion, said two cylinders are moved axially away from each other in a spaced work position.

19. A method as claimed in claim 18, wherein while knitting with reciprocating motion said two cylinders are torsionally connected to each other by means of an angular connection device arranged inside the two cylinders.

20. A method as claimed in claim 1, wherein said two cylinders are maintained, both while knitting the body and while knitting the leg pieces, at such a distance that the needles of one cylinder do not penetrate between the needles of the other cylinder.

21. A method as claimed in claim 1, wherein all the needles of the cylinders form stitch in the knitting phase of said at least one part of the body with reciprocating motion.

22. A double cylinder circular knitting machine to produce a garment such as briefs, tights or the like, comprising two superimposed needle cylinders, controlled to perform the steps of:

knitting at least one part of the body with reciprocating motion of the two cylinders;

knitting the leg pieces with a continuous rotary motion of the two cylinders, a first leg piece being knitted by a first of said cylinders and a second leg piece being knitted by a second of said cylinders, wherein said machine is further controlled such that while knitting the body with reciprocating motion of the two superimposed cylinders, all the needles of at least one arc of needles of the upper cylinder and all the needles of a corresponding arc of needles of the lower cylinder are set to work, and at least two feeds and at least two yarns are used.

23. A machine as claimed in claim 22, wherein the two cylinders are angularly offset relative to each other so that each cylinder has its own needles aligned with the sinkers of the other cylinder, so that the needles of one cylinder do not interfere with the needles of the other cylinder while working the garment, and both the cylinders can be used in their effective fineness for knitting all the parts of the garment.

24. A machine as claimed in claim 23, wherein the sinkers have a hook and a butt, between said hook and said butt being arranged a recess suitable to allow the passage of the corresponding needle of the opposite cylinder when the needle forms stitch, the sinkers of a cylinder being maintained advanced when the needles of the other cylinder are actuated to form stitch.

25. A machine as claimed in claim 22, wherein the sinkers of the two cylinders have the stitch forming plane nearly aligned with the upper part of a hook.

26. A machine as claimed claim 22, wherein each cylinder comprises control cams for controlling respective sinkers, provided with an angular movement so as to allow an angular variation of the position of the cams during the various working phases of the machine.

27. A machine as claimed in claim 26, wherein, in each return stroke of the reciprocating motion, in which the needles of one of said cylinders do not work, the control cams for controlling the sinkers of said cylinder, whose needles do not work, are offset by an angle relative to their normal angular position used in the continuous motion phases, so as to delay the exit of the corresponding sinkers with respect to the point of stitch formation of the other of said two cylinders, whose needles are working, thus avoiding interferences with said working needles of said other cylinder.

28. A machine as claimed in claim 22, wherein the two cylinders are movable so as to assume alternatively two knitting positions, respectively a first adjacent position and a second spaced position of the two cylinders, an angular connection device being provided to constrain torsionally the two cylinders when the two cylinders are in the first adjacent position.

29. A machine as claimed in claim 28, wherein said angular return device is arranged inside the two cylinders.

30. A machine as claimed in claim 29, wherein said angular return device comprises a pin carried by a first of said cylinders and a seat carried by a second of said cylinders, the axial advancing movement of the two cylinders causing the penetration of the pin into the seat.

31. A machine as claimed in claim 30, wherein said pin and said seat are rigidly connected to the respective cylinders.

32. A knitted garment comprising:

a body and two leg pieces, joined along a crotch area, said body and said leg pieces being formed by a continuous knitted fabric in a seamless manner, wherein both the body and the leg pieces are formed each by at least two yarns and the body is formed with a number of stitch columns greater than the number of stitch columns forming one of said leg pieces.

33. A garment as claimed in claim 32, wherein at least one part of said body is formed by a number of stitch columns comprised between 1.4 e 1.9 times the number of stitch columns of one of said leg pieces, and preferably comprised between 1.5 e 1.9 and more preferably between 1.6 e 1.9 times the number of stitch columns of one of said leg pieces.

34. A garment as claimed in claim 32, wherein both the body and the leg pieces are formed with at least one "S" yarn and at least one "Z" yarn.

35. A garment as claimed in claim 32, wherein said body and said leg pieces are formed by respective portions of tubular knitted fabric, the columns of stitches forming the body extending until forming part of the leg piece.

36. A garment as claimed in claim 32, wherein said body comprises at least one upper part formed by two portions joined along two interstitch lines developing on a front portion and on a rear portion of the garment.

37. A garment as claimed in claim 32, wherein said upper part is formed by a number of stitch columns greater than the number of stitch columns of one of said leg pieces.

38. A garment as claimed in claim 32, wherein in the crotch area a joining line is provided, for joining the two leg pieces, which line is formed by at least an interknitting course, and preferably by two interknitting courses, common to the two leg pieces.

39. A garment as claimed in claim 37, wherein:

in the crotch area a joining line is provided, for joining the two leg pieces, which line is formed by at least one interknitting course common to the two leg pieces;

said body comprises a lower part constituting the prosecution of the upper part and developing until the lower part forms the crotch area and the leg pieces of the garment;

said interstitch lines extend in the upper part of the body and the front interstitch line is joined to the rear interstitch line by said interknitting, which extends along the lower part of the body.

40. A garment as claimed in claim 38, wherein said interknitting is formed by yarns which form an upper part of said body.

41. A garment as claimed in claim 38, wherein said body is formed by columns of stitches, which extend from a waist of the body to the leg pieces and, in the lower part, by further columns of stitches, which extend from said interknitting to said leg pieces.

42. A garment as claimed in claim 38, wherein:

said two leg pieces are formed by an equal number of columns of leg piece stitches;

said interknitting is formed by a number of columns of interknitting stitches; and said body comprises an upper part formed by a number of columns of body stitches equal to the sum of the number of columns of stitches of the two leg pieces, minus a number of columns of interknitting stitches.

43. A garment as claimed in claim 42, wherein the lower part of said body is formed by a number of columns of stitches equal to the sum of the number of columns of stitches of the two leg pieces, part of which form said interknitting.

44. A garment as claimed in claim 42, wherein said number of columns of interknitting stitches is lower than the half of the number of columns of stitches of each leg piece.

45. A garment as claimed in claim 32, wherein said two leg pieces are formed by the same number of stitch columns and said body is formed by a number of stitch columns equal to the sum of the stitch columns of the two leg pieces.

46. A method as claimed in claim 2, wherein while knitting said at least one part of the body with reciprocating motion, an even number of feeds and yarns is used, with at least one yarn "S" and at least one yarn "Z", and each leg piece is knitted with at least two feeds and at least one "S" yarn and one "Z" yarn.

47. A method as claimed in claim 3, wherein while knitting said at least one part of the body with reciprocating motion, an even number of feeds and yarns is used, with at least one yarn "S" and at least one yarn "Z", and each leg piece is knitted with at least two feeds and at least one "S" yarn and one "Z" yarn.

48. A machine as claimed in claim 23, wherein the sinkers of the two cylinders have the stitch forming plane nearly aligned with the upper part of a hook.

49. A machine as claimed in claim 24, wherein the sinkers of the two cylinders have the stitch forming plane nearly aligned with the upper part of a hook.

50. A garment as claimed in claim 33, wherein both the body and the leg pieces are formed with at least one "S" yarn and at least one "Z" yarn.

* * * * *